US006350015B1

(12) United States Patent
Gooray et al.

(10) Patent No.: US 6,350,015 B1
(45) Date of Patent: Feb. 26, 2002

(54) MAGNETIC DRIVE SYSTEMS AND METHODS FOR A MICROMACHINED FLUID EJECTOR

(75) Inventors: Arthur M. Gooray; George J. Roller, both of Penfield, NY (US); Joseph M. Crowley, Jr., Morgan Hill, CA (US); Paul C. Galambos; Frank J. Peter, both of Albuquerque, NM (US); Kevin R. Zavadil, Bernilillo, NM (US); Richard C. Givler; D. Russell Humphreys, both of Albuquerque, NM (US); Jeffry J. Sniegowski, Edgewood, NM (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/718,495

(22) Filed: Nov. 24, 2000

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63, 11, 48, 9, 87, 55, 59, 19, 56, 3, 93, 92, 17; 399/261; 361/700; 310/328–30; 29/890.1

(56) References Cited

U.S. PATENT DOCUMENTS

| | | | |
|---|---|---|---|
| 4,520,375 | A | 5/1985 | Kroll |
| 5,501,893 | A | 3/1996 | Laermer et al. |
| 5,668,579 | A | 9/1997 | Fujii et al. |
| 5,754,205 | A | 5/1998 | Miyata et al. |
| 5,783,340 | A | 7/1998 | Farino et al. |
| 5,798,283 | A | 8/1998 | Montague et al. |
| 5,804,084 | A | 9/1998 | Nasby et al. |
| 5,821,951 | A | 10/1998 | Fujii et al. |
| 5,828,394 | A | 10/1998 | Khuri-Yakub et al. |
| 5,919,548 | A | 7/1999 | Barron et al. |
| 5,963,788 | A | 10/1999 | Barron et al. |
| 6,082,208 | A | 7/2000 | Rodgers et al. |
| 6,127,198 | A | 10/2000 | Coleman et al. |

*Primary Examiner*—Raquel Yvette Gordon
(74) *Attorney, Agent, or Firm*—Oliff & Berridge, PLC

(57) ABSTRACT

The systems and methods of the present invention operate by magnetically driving a fluid ejector. In various exemplary embodiments, a primary coil and a secondary coil are situated in the ejector. The ejector has a movable piston usable to eject fluid through a nozzle hole. The piston may be resiliently mounted and biased to an at-rest position. A drive signal is applied to cause current to flow in the primary coil. The current flow generates a magnetic field that induces a current in the secondary coil. Either the primary coil or the secondary coil or associated with the piston and the other is associated with a fixed structure of the ejector. As a result, a magnetic force is generated that pushes the piston either toward a faceplate so that a drop of fluid is ejected through the nozzle hole in the faceplate or away from the faceplate so that fluid fills in a fluid chamber between the piston and the faceplate. When the drive signal is turned off, the piston resiliently returns to its at-rest position, thereby either refilling the ejected fluid or ejecting a drop of fluid through the nozzle hole in the faceplate. In various other embodiments, the faceplate is made of a magnetic material, such as a ferrous material, or is coated with or connected to a magnetic material. A second primary coil or a permanent magnet may be included in various other embodiments. In various embodiments, switching the direction of the current changes the magnetic force between attraction and repulsion.

28 Claims, 22 Drawing Sheets

MAGNETIC DRIVE SYSTEMS AND METHODS FOR A MICROMACHINED FLUID EJECTOR

BACKGROUND OF THE INVENTION

1. Field of Invention

This invention relates to microelectromechanical system (MEMS)—based fluid ejectors or micromachined fluid ejectors.

2. Description of the Related Art

Fluid ejectors have been developed for ink jet recording or printing. Ink jet recording apparatuses offer numerous benefits, including extremely quiet operation when recording, high speed printing, a high degree of freedom in ink selection, and the ability to use low-cost plain paper. In the so-called "drop-on-demand"(hive method, which is now the conventional approach, ink is output only when required for recording. The drop-on-demand drive method makes it unnecessary to recover ink not needed for recording.

Fluid ejectors for ink jet printing include one or more nozzles which allow the formation and control of small ink droplets to permit high resolution, resulting in the ability to print sharper characters with improved tonal resolution. In particular, drop-on-demand ink jet printheads are generally used for high resolution printers.

Drop-on-demand technology generally uses some type of pulse generator to form and eject the ink drops. For example, in one type of ink jet printhead, a chamber having an ink nozzle may be fitted with a piezoelectric wall that is deformed when a voltage is applied. As a result of the deformation, a drop of the fluid is forced out of the nozzle orifice and impinges directly on an associated printing surface. Use of such a piezoelectric device as a nozzle driver is described in JP B-1990-51734.

Another type of printhead uses bubbles formed by heat pulses to force fluid out of the nozzle. The drops are separated from the ink supply when the bubbles collapse. Use of pressure generated by heating the ink to generate bubbles is described in JP B-1986-59911.

Yet another type of "drop-on-demand"printhead incorporates an electrostatic actuator. This type of printhead utilizes electrostatic force to eject the ink. Examples of such electrostatic print heads are discussed in U.S. Pat. No. 5,754,205 to Miyata et al., U.S. Pat. No. 4,520,375 to Kroll and Japanese Laid-Open Patent Publication No. 289351/90, each incorporated herein by reference. The ink jet printhead discussed in the 375 patent uses an electrostatic actuator comprising a diaphragm that constitutes a part of an ink ejection chamber and a base plate disposed outside of the ink ejection chamber opposite the diaphragm. The ink jet printhead ejects fluid droplets through a nozzle in communication with the ejection chamber by applying a time-varying voltage between the diaphragm and the base plate. The diaphragm and the base plate thus act as a capacitor that causes the diaphragm to be set into mechanical motion and a drop of the fluid to exit the ejection chamber in response to the diaphragm motion. On the other hand, the ink jet printhead discussed in Japan 351 distorts its diaphragm by applying voltage to an electrostatic actuator fixed on the diaphragm. This result in suction of fluid into the ejection chamber. Once the voltage is removed, the diaphragm is restored to its non-distorted condition, ejecting the fluid from the ejection chamber.

Fluid drop ejectors may be used not only for printing, but also for depositing photoresist and other liquids in the semiconductor and flat panel display industries, for delivering drug and biological samples, for delivering multiple chemicals for chemical reactions, for handling DNA sequences, for delivering drugs and biological materials for interaction studies and assaying, and for depositing thin and narrow layers of plastics for usable as permanent and/or removable gaskets in micro-machines.

SUMMARY OF THE INVENTION

As noted above, fluid jet ejectors typically use thermal actuation, piezoelectric actuation, or, in the case of the fluid jet ejector disclosed in the 205 patent, electrostatic actuation, to eject drops. These types of actuation may involve drawbacks for certain applications. For example, piezoelectric actuators require multi-step very-small-scale assembly involving forming and attaching the piezoelectric material into an ejector assembly. In addition, the resulting piezoelectric actuator assembly is too large for efficient, dense packing. Thermal actuators require a relatively large amount of energy and can only produce drops of a single size. Electrostatic actuators have the potential for compact, integrated, monolithic fabrication (i.e., little or no assembly required) with drop size modulation. Electrostatic actuators, however, are sensitive to the electrical properties of the fluid, including the dielectric constant, the breakdown voltage, and the conductivity of the fluid, as the fluid is effectively part of the actuation system.

This invention provides systems and methods that enable a high performance fluid ejection driver.

This invention separately provides a fluid ejection driver that can be manufactured with lower cost.

This invention separately provides fluid ejection drivers that operate independently of the fluid to be ejected.

This invention separately provides fluid ejection drivers that are able to modulate the drop size on demand.

This invention separately provides fluid ejection drivers that are able to operate with a reduced applied drive voltage.

This invention separately provides magnetic fluid ejection drivers.

This invention further provides magnetic fluid ejection drivers that use a current loop.

This invention separately provides magnetic fluid ejection drive using a magnetic material.

This invention separately provides magnetic fluid ejection drivers that include a permanently magnetized material.

This invention separately provides magnetic fluid ejection drivers in which a strong magnetic field is produced for a given applied current.

This invention separately provides magnetic fluid ejection drivers in which a given magnetic field is produced by a reduced applied current.

This invention separately provides magnetic fluid ejection drivers in which a movable member is driven by a repulsive magnetic force.

This invention separately provides magnetic fluid ejection drivers in which a movable member is driven by an attractive magnetic force.

This invention separately provides a micromachined fluid ejector in which the foregoing drawbacks are reduced, if not eliminated.

In various exemplary embodiments of the systems and methods of this invention, magnetic forces are used to drive a movable member of a fluid ejector. Various exemplary embodiments include at least one primary current coil to which a drive signal is applied. Various exemplary embodiments use magnetic materials, permanently magnetized materials, permanent magnets and/or secondary coils to achieve a desired magnetic field within the fluid ejector. In various exemplary embodiments, the permanently magnetized material is a permanent magnet.

In various exemplary embodiments, the magnetic fluid ejection driver uses only one controlled current. In various other exemplary embodiments, the magnetic fluid ejection driver uses two controlled currents. In still other various exemplary embodiments, the magnetic fluid ejection driver uses an induced secondary current.

In various exemplary embodiments, the magnetic fluid ejection driver controllably moves a movable member of the fluid ejector in a single direction. In various other exemplary embodiments, the magnetic fluid ejection driver controllably moves the movable member in two opposite directions.

In various exemplary embodiments, the movable member ejects fluid when driven. In various other exemplary embodiments, the movable member ejects fluid after being driven.

These and other features and advantages of this invention are described in, or are apparent from, the following detailed description of various exemplary embodiments of the systems and methods of this invention.

BRIEF DESCRIPTION OF THE DRAWINGS

Various exemplary embodiments of the systems and methods of this invention will be described in detail below, with reference to the following drawing figures, in which.

DETAILED DESCRIPTION OF EXEMPLARY EMBODIMENTS

The systems and methods of this invention operate by magnetically driving a fluid ejector. Although the following description is provided in terms of an exemplary-ejector that has a piston and faceplate configuration, it should be understood that the systems and methods of this invention are applicable to, and may be embodied in, various other configurations of fluid ejectors. For example, the systems and methods of this invention may readily be applied to diaphragm configurations or any other currently known or later developed fluid ejector designs.

The systems and methods of this invention use magnetically-generated forces to move a moveable member of the fluid ejector. Such a magnetic driver has advantages over electrostatic and thermal actuation drives in that the magnetic driver is independent of the fluid. Therefore, any fluid may be used. The magnetic driver also provides an inherently lower voltage, although higher current, driver than a conventional electrostatic actuation driver.

When a piston and faceplate configuration is used, the magnetically-generated forces may drive the piston towards the faceplate, ejecting a drop through a nozzle hole in the faceplate. This provides direct or active control of the fluid ejection process.

Alternatively, the magnetic forces may drive the piston away from the faceplate. In this case, the piston may eject a drop through the nozzle hole using resilient forces that restore the piston to its at-rest position. This provides indirect or passive control of the fluid ejection process.

It should also be appreciated that the magnetic forces can be used to drive the piston both towards and away from the faceplate. This provides direct or active control of the fluid ejection process and also assists in refilling the fluid into the ejector.

FIGS. 1–8 illustrate various exemplary configurations of a first exemplary embodiment of a fluid ejector 100 including a magnetic drive system according to this invention. It should be appreciated that the configurations shown in FIGS. 1–8 are provided as examples only, and are not exhaustive or limiting.

Figure 1:
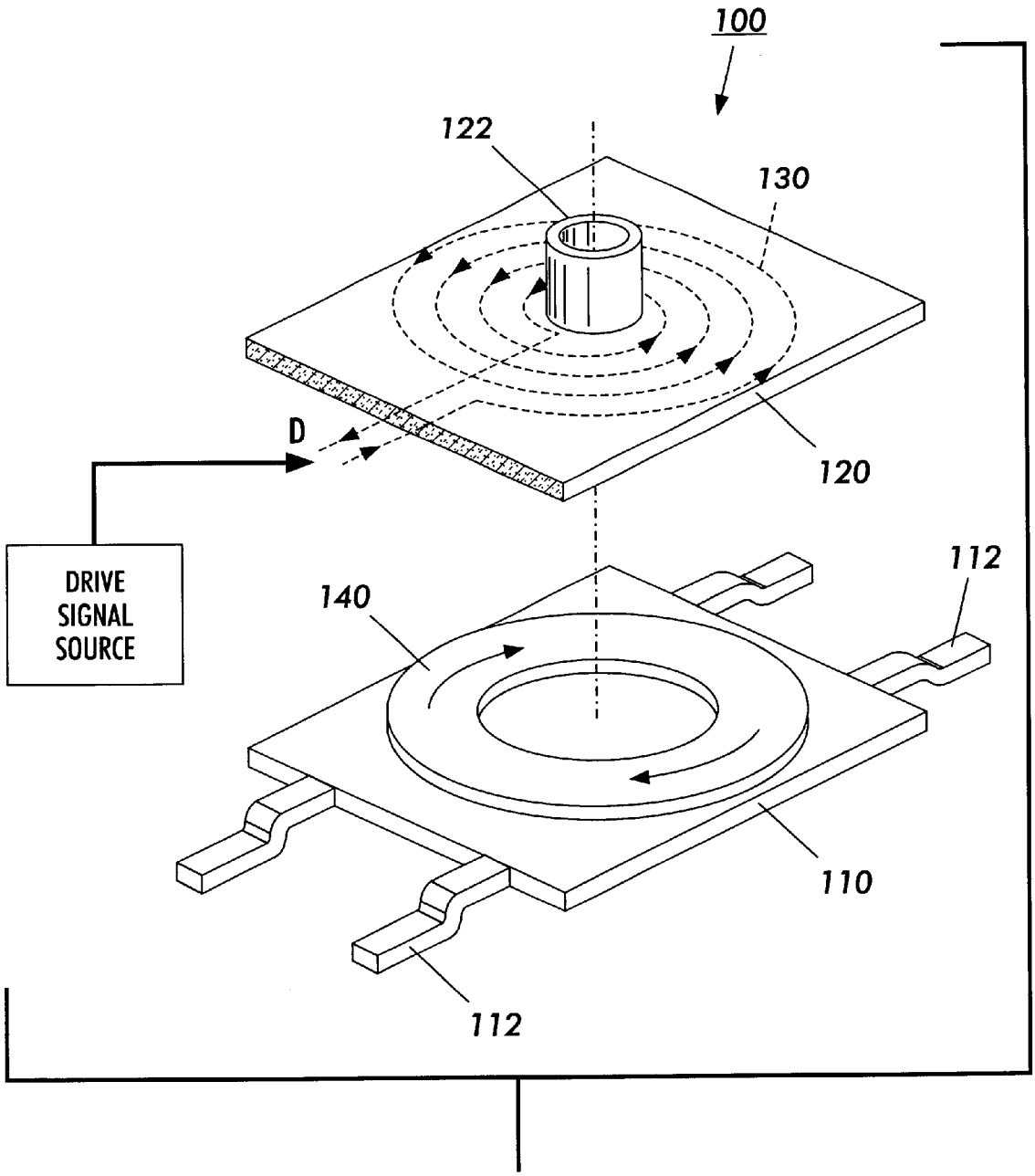
FIG. 1 is an exploded perspective view of a fluid ejector including a first exemplary configuration of a first exemplary embodiment of a magnetic drive system according to this invention.
Figure 2:
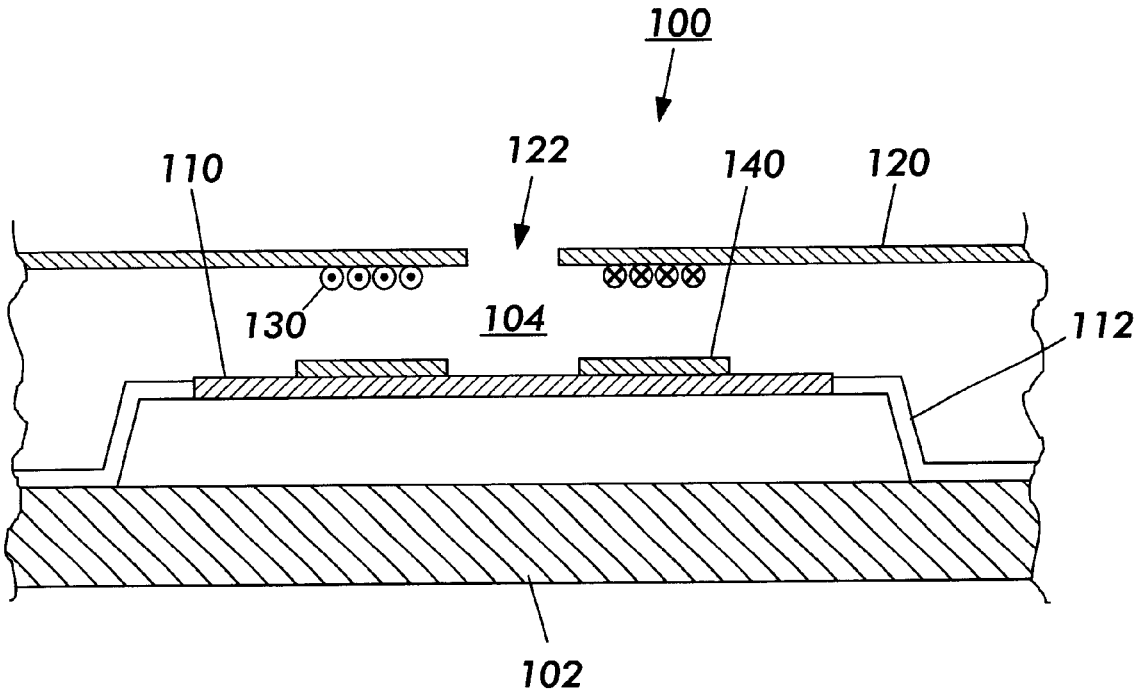
FIG. 2 is a cross-sectional view of the fluid ejector of FIG. 1.

In the first exemplary embodiment shown in FIGS. 1–8, the fluid ejector 100 has a resiliently mounted, movable piston 110 usable to eject fluid through a nozzle hole 122. The piston 110 may include one or more spring elements 112 that are connected to a fixed portion of the fluid ejector 100, such as, for example, a substrate 102, as shown in FIG. 2. The spring elements 112 bias the piston 110 to an at-rest position. The fluid ejector 100 also has a faceplate 120 that includes the nozzle hole 122 through which a drop of fluid may be ejected.

A primary coil 130 to which a drive signal D is to be applied is situated in the fluid ejector 100. Further, a secondary coil 140 is situated in the fluid ejector 100. One of the primary coil 130 and the secondary coil 140 is associated with the piston 110. It should be appreciated that the primary coil 130 or the secondary coil 140 may be associated with the piston 110 in any suitable manner that causes the piston 110 to experience a force acting on the primary coil 130 or the secondary coil 140, respectively. For example, as shown in FIGS. 1 and 2, the primary coil 130 or the secondary coil 140 may be mounted on or formed on a surface of the piston 110. The primary coil 130 or the secondary coil 140 may also be embedded in or formed as part of the piston 110. The other of the primary coil 130 and the secondary coil 140 is associated with a fixed portion or structure of the fluid ejector 100.

In operation, a drive signal D is applied by a drive signal source to the primary coil 130. The drive signal D causes a current to flow in the primary coil 130. The current flow in the primary coil 110 generates a magnetic field. Simultaneously, a current is induced in the secondary coil 140. As a result, a repulsive magnetic force is generated between the primary coil 110 and the secondary coil 140. Since one of the primary coil 130 and the secondary coil 140 is associated with the piston 110 and the other of the primary coil 130 and the secondary coil 140 is associated with a fixed portion or structure of the fluid ejector 100, the piston 110 is moved by the magnetic force, either towards or away from the faceplate 120, which is also a fixed structure of the fluid ejector 100.

When the magnetic force moves the piston 110 away from the faceplate 120, fluid from a fluid reservoir (not shown) fills between the faceplate 120 and the piston 110. Then, when the drive signal D is turned off, the current flowing in the primary coil 130 is stopped, removing the magnetic field, ending the induced current and eliminating the magnetic force. The piston 110 then resiliently returns to its at-rest position under the bias of the spring elements 112. When the piston 110 is moved away from the faceplate to overfill the ejection chamber 104, removing the drive signal D causes a drop of fluid to be ejected through the nozzle hole 122 in the faceplate 120. In this case, fluid ejection is indirectly or passively controlled by the drive signal D, as fluid is ejected only after the drive signal D is removed.

When the magnetic force moves the piston 110 toward the faceplate 120, a drop of fluid is ejected through the nozzle hole 122 in the faceplate 120. Then, when the drive signal D is turned off, the current flowing in the primary coil 130 is stopped, removing the magnetic field, ending the induced current in the secondary coil 140 and eliminating the magnetic force therebetween. The piston 110 then resiliently returns to its at-rest position under a force of the springs 112, thereby refilling the ejected fluid in the fluid ejector 100. In this latter case, fluid ejection is directly or actively controlled by the drive signal D of the drive signal source.

FIGS. 1 and 2 show a first exemplary configuration of the fluid ejector 100 in which the primary coil 130 is associated with the faceplate 120. A first current path is defined by the primary coil 130. The secondary coil 140 is associated with the piston 110. A second current path is defined by the secondary coil 140.

In operation, the drive signal source applies the drive signal D to the primary coil 130 so that current flows in the primary coil 130 in a first direction, as indicated by the current flow direction arrows on the primary coil 130. This generates a magnetic field that induces a current in the secondary coil 140 in a second direction opposite the first direction, as indicated by the current flow direction arrows on the secondary coil 140. The currents in the primary and secondary coils 130 and 140 generate a repulsive magnetic force that pushes the piston 110 away from the faceplate 120, causing additional fluid additional to enter into and overfill fluid chamber 140 formed between the piston 110 and the faceplate 120.

When the drive signal D is turned off, the current flowing in the primary coil 130 ceases, the magnetic field is eliminated, the current flowing in the secondary coil 140 ceases and the repulsive magnetic force acting on the piston 110 is removed. The piston 110 then returns to its at-rest position under the bias of the spring elements 112. This return motion causes a drop of fluid to be driven out through the nozzle hole 122 by the piston 110.

It should be appreciated that operation of the first exemplary configuration shown in FIGS. 1 and 2 requires only one controlled current. Further, reversing the direction of the current flowing in the primary coil 130 does not change the operation of the magnetic drive system. The second direction of the current induced in the secondary coil 140 remains opposite to the first direction of the current flowing in the primary coil 130. In particular, to induce the eddy current on the secondary coil 140, the current flow in the primary coil 130 caused by application of the drive signal D is an alternating current.

Figure 3:
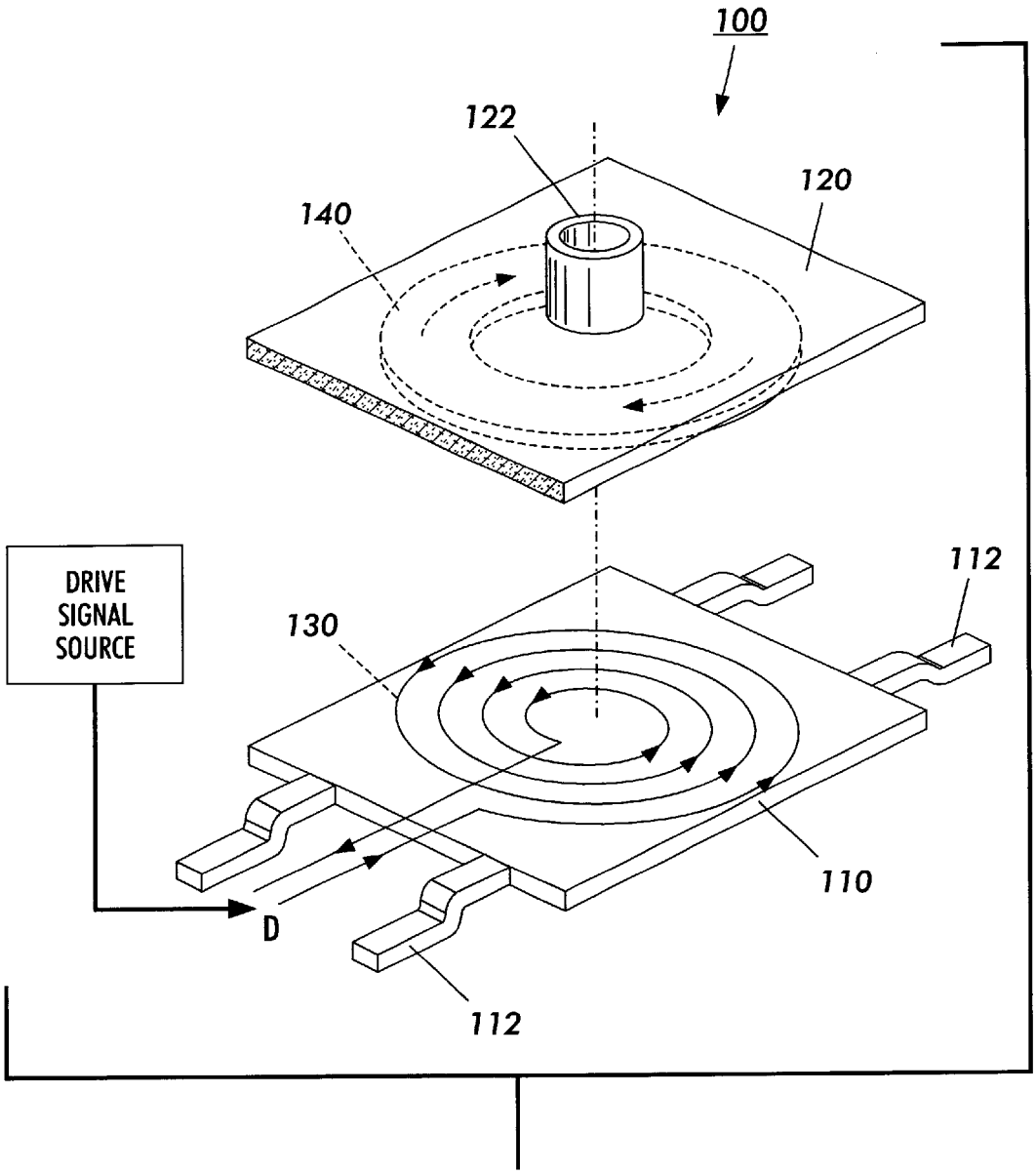
FIG. 3 is an exploded perspective view of a second exemplary configuration of the first exemplary embodiment of the fluid ejector shown in FIG. 1.
Figure 4:
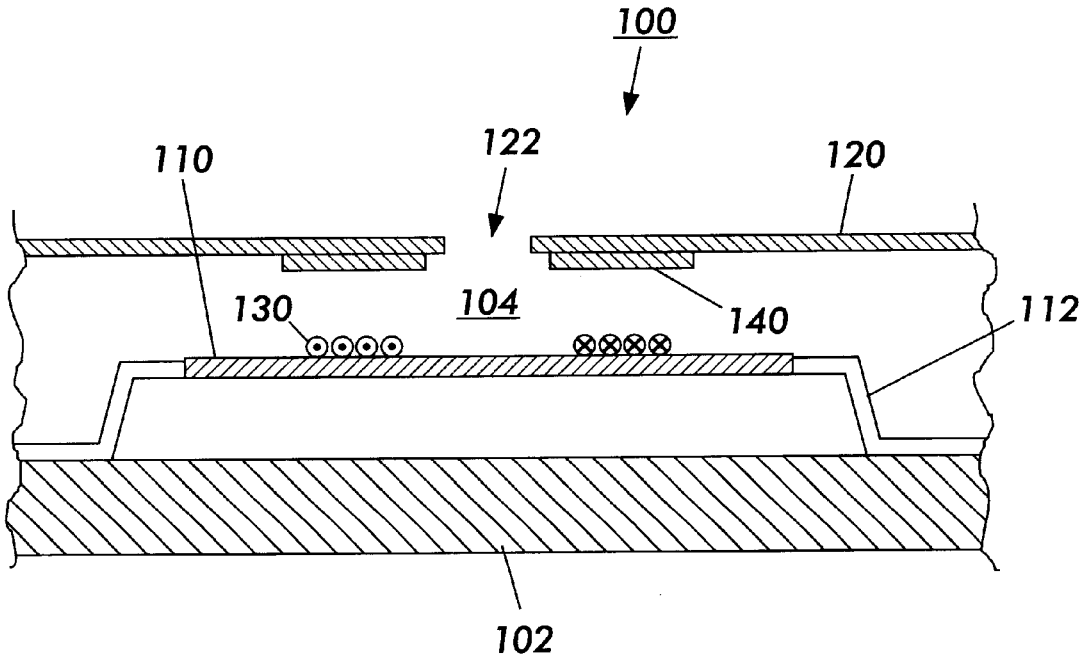
FIG. 4 is a cross-sectional view of the fluid ejector of FIG. 3.

FIGS. 3 and 4 show a second exemplary configuration of the fluid ejector 100 in which the primary coil 130 is associated with the piston 110 and the secondary coil 140 is associated with the faceplate 120. The operation of this second exemplary configuration is identical to that described above for the first configuration shown in FIGS. 1 and 2. Again, only one controlled alternating current in the primary coil 130 is needed. However, the different configurations of FIGS. 1 and 2 and FIGS. 3 and 4 allow for flexibility in arranging and locating the drive signal source.

Figure 5:
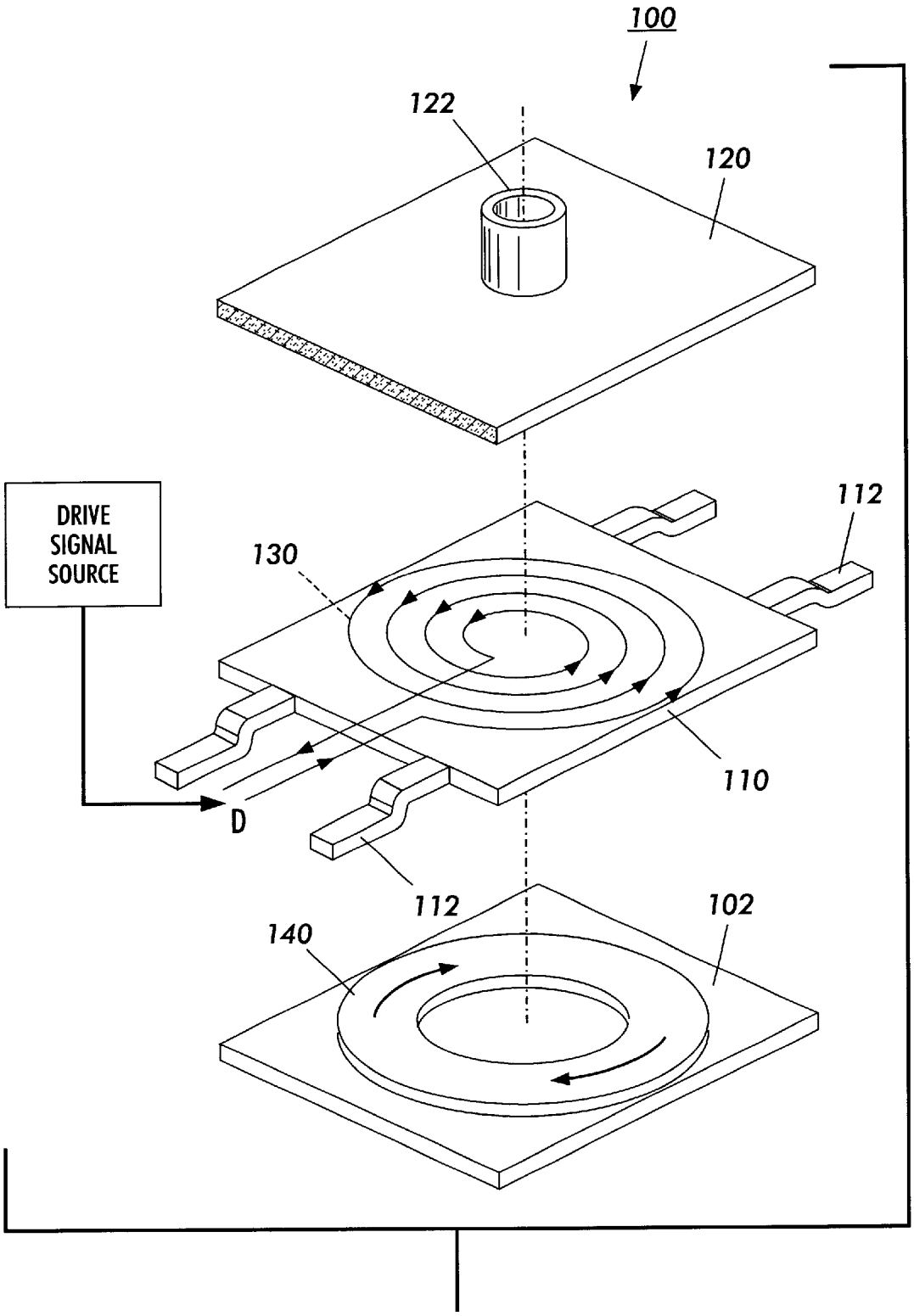
FIG. 5 is an exploded perspective view of a third exemplary configuration of the first exemplary embodiment of the fluid ejector shown in FIG. 1.
Figure 6:
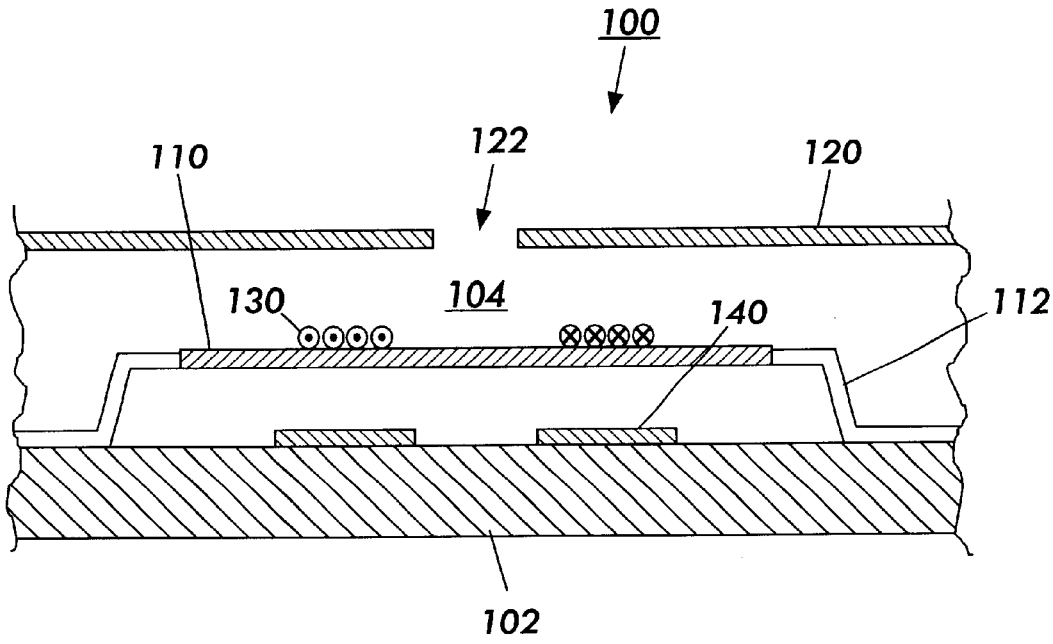
FIG. 6 is a cross-sectional view of the fluid ejector of FIG. 5.

FIGS. 5 and 6 show a third exemplary configuration of the fluid ejector 100 in which the primary coil 130 is associated with the piston 110 and the secondary coil 140 is associated with the substrate 102.

In this third configuration, in operation, the drive signal source applies the drive signal D to the primary coil 130 so that current flows in the primary coil 130 in the first direction, as indicated by the current flow direction arrows on the primary coil 130. This generates a magnetic field that induces a current in the secondary coil 140 in the second direction opposite the first direction, as indicated by the current flow direction arrows on the secondary coil 140. The currents in the primary and secondary coils 130 and 140 generate a repulsive magnetic force that pushes the piston 110 away from the substrate 102 and towards the faceplate 120, so that the piston 110 ejects a drop of fluid through the nozzle hole 122.

When the drive signal D is turned off, the current flowing in the primary coil 130 ceases, the magnetic field is eliminated, the current flowing in the secondary coil 140 ceases and the repulsive magnetic force acting on the piston 110 is removed. The piston 110 then returns to its at-rest position under the bias of the spring elements 112. This return motion causes fluid to refill the fluid chamber 104 between the piston 110 and the faceplate 120.

Operation of the third configuration shown in FIGS. 5 and 6 also requires only one controlled alternating current. However, this third exemplary configuration advantageously directly or actively controls the ejection of a drop of fluid from the fluid ejector 100.

Figure 7:
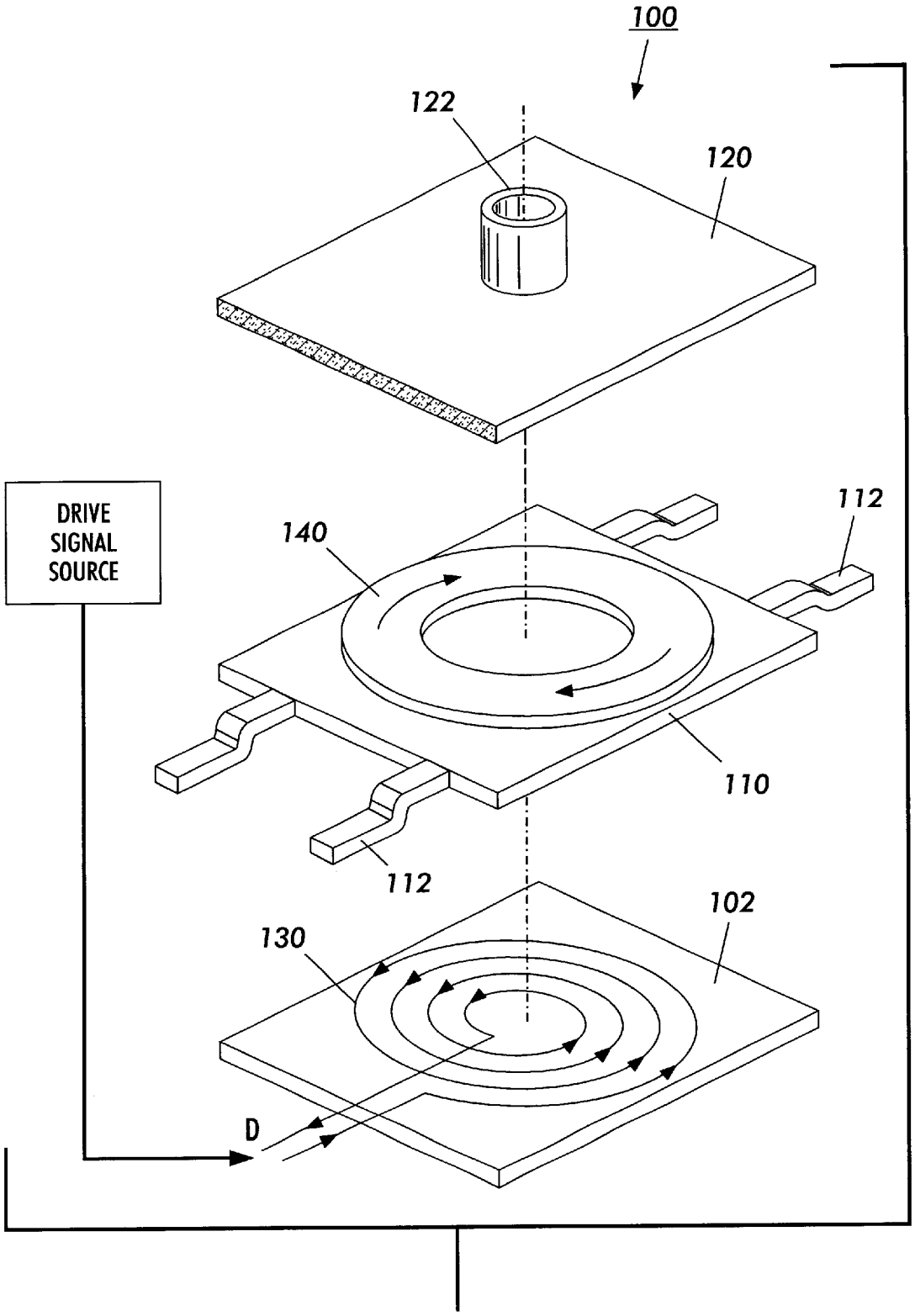
FIG. 7 is an exploded perspective view of a fourth exemplary configuration of the first exemplary embodiment of the fluid ejector shown in FIG. 1.
Figure 8:
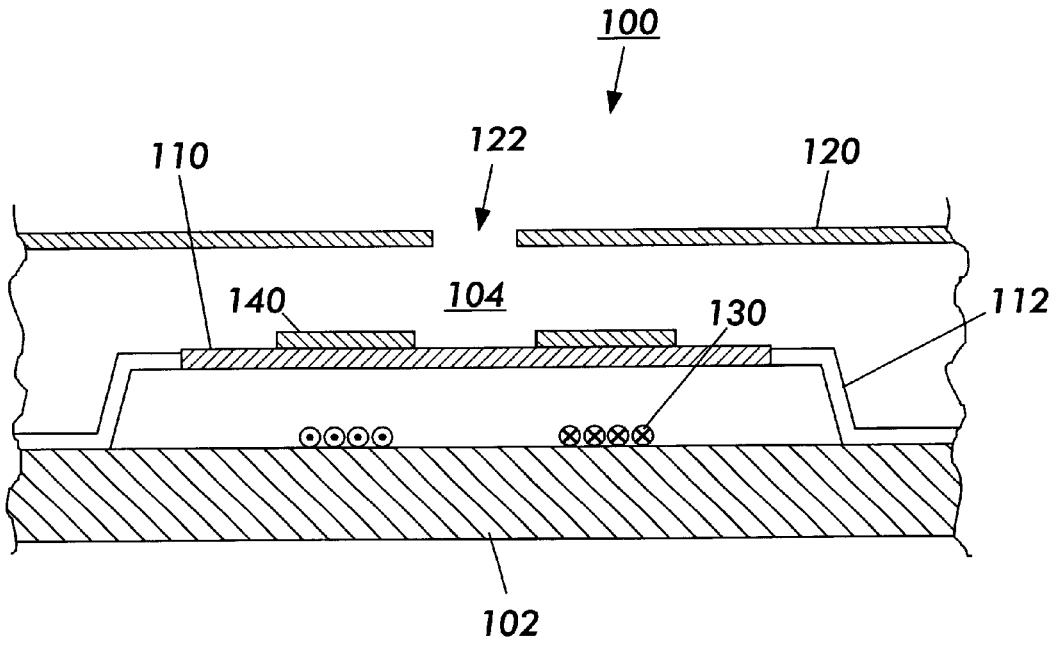
FIG. 8 is a cross-sectional view of the fluid ejector of FIG. 7.

FIGS. 7 and 8 show a fourth exemplary configuration of the fluid ejector 100 in which the primary coil 130 is associated with the substrate 102 and the secondary coil 140 is associated with the piston 110. The operation of this fourth exemplary configuration is identical to that described above for the third exemplary configuration shown in FIGS. 5 and 6. Again, only one controlled alternating current in the primary coil 130, is needed to operate the fluid ejector 100. This fourth exemplary configuration also advantageously directly or actively controls the ejection of a drop of fluid from the fluid ejector 100. However, the different configurations of FIGS. 5 and 6 and FIGS. 7 and 8 allow flexibility in arranging and locating the drive signal source.

FIGS. 9–16 illustrate various exemplary configurations of a second exemplary embodiment of a fluid ejector 200 including a magnetic drive system according to this invention. It should be appreciated that the configurations shown in FIGS. 9–16 are provided as examples only, and are not exhaustive or limiting.

Figure 9:
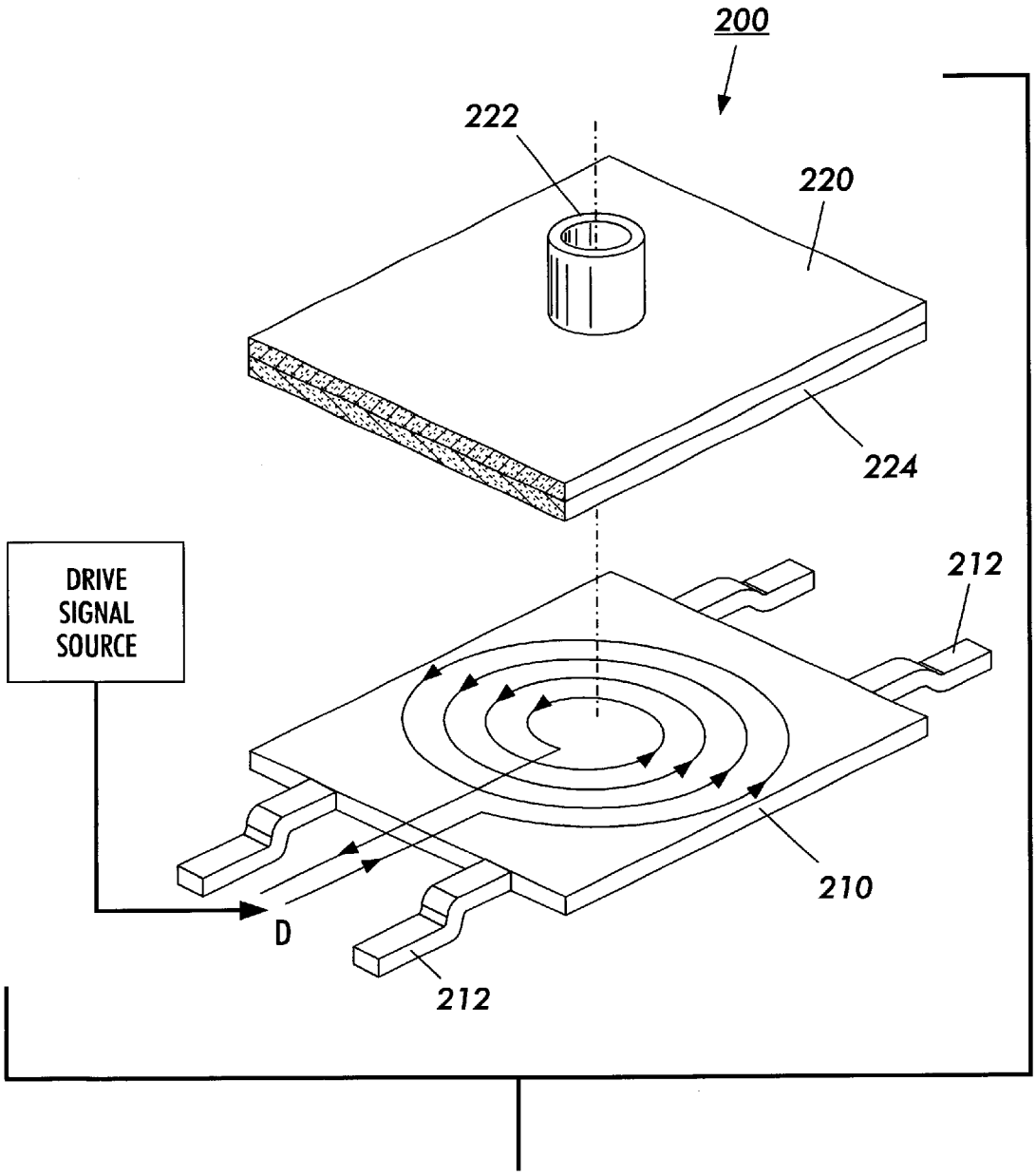
FIG. 9 is an exploded perspective view of a fluid ejector including a first exemplary configuration of a second exemplary embodiment of a magnetic drive system according to this invention.
Figure 10:
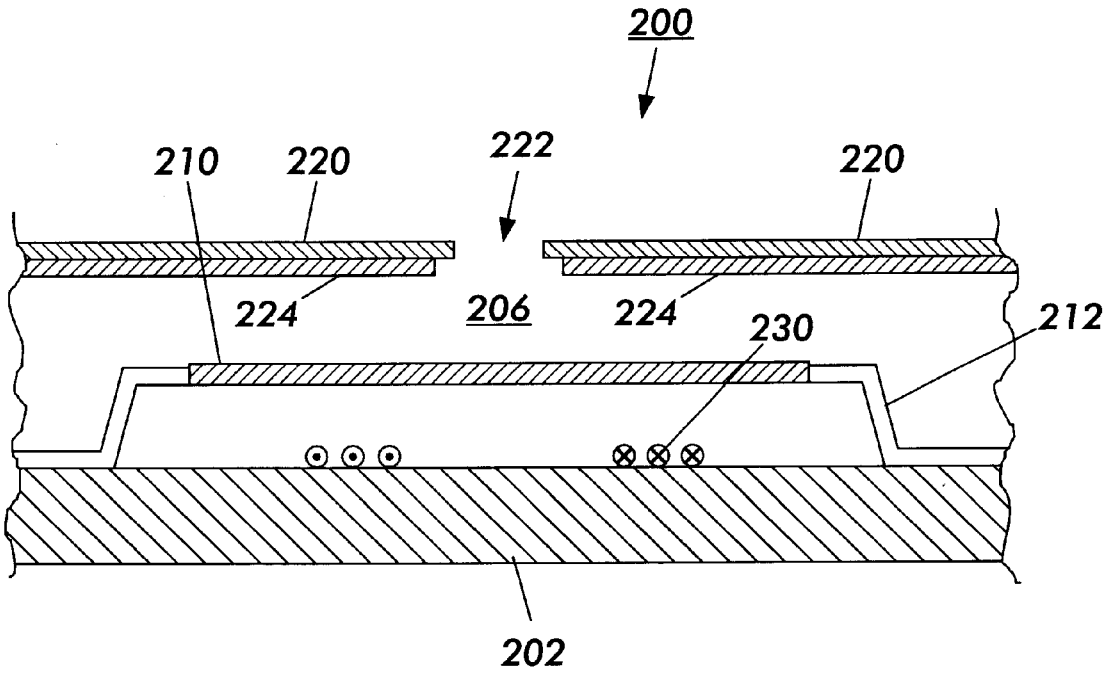
FIG. 10 is a cross-sectional view of the fluid ejector of FIG. 9.

In the second exemplary embodiment shown in FIGS. 9–16, the fluid ejector 200 has a movable piston 210 usable to eject fluid through a nozzle hole 222. The piston 210 may be resiliently mounted and may include one or more spring elements 212 that are connected to a fixed portion of the fluid ejector 200, such as, for example, a substrate 202, as shown in FIG. 10. The spring elements 212 bias the piston 210 to an at-rest position. The fluid ejector 200 also has a faceplate 220 that includes the nozzle hole 222 through which a drop of fluid may be ejected.

A primary coil 230 to which a drive signal D is to be applied is situated in the fluid ejector 200. Further, at least one element, such as the element 204, 214 or 224, is formed from a magnetic material, such as a ferrous material, and is situated in the fluid ejector 200. Either the primary coil 230 or the magnetic material element 204, 214 or 224 is associated with the piston 210. It should be appreciated that the primary coil 230 or the magnetic material element 204, 214 or 224 may be associated with the piston 210 in any suitable manner that causes the piston 210 to experience a force acting on the primary coil 230 or the magnetic material element 204, 214 or 224, respectively. For example, the primary coil 230 may be mounted on or formed on a surface of the piston 210. The primary coil 230 may also be embedded in or formed as part of the piston 210. Alternatively, the piston 210 may be fabricated from a magnetic material, or coated with, or otherwise connected to the magnetic material element 204, 214 or 224. The other of the primary coil 230 and the magnetic material element 204, 214 or 224 is associated with a fixed portion or structure of the fluid ejector 200.

In operation, a drive signal D is applied by a drive signal source to the primary coil 230. The drive signal D causes a current to flow in the primary coil 230. The current flow in the primary coil 230 generates a magnetic field. In operation, the current may flow in either direction in the primary coil 230, with the piston 210 resiliently mounted as described above. Since one of the primary-coil 230 and the magnetic material element 204, 214 or 224 is associated with the piston 210, while the other of the primary coil 230 and the magnetic material element 204, 214 or 224 is associated with a fixed portion or structure of the fluid ejector 200, the piston 210 is moved by the magnetic force either towards or away from the faceplate 220, which is also a fixed structure in the fluid ejector 200, depending on the relative locations of the primary coil 230 and the element of the fluid ejector formed from the magnetic material.

When the magnetic force moves the piston 210 away from the faceplate 220, fluid from a fluid reservoir (not shown) refills or overfills the a fluid chamber 206 between the faceplate 220 and the piston 210. Then, when the drive signal D is turned off, the current flowing in the primary coil 230 is stopped, removing the magnetic field and eliminating the magnetic force. The piston 210 then resiliently returns to its at-rest position under a force of the spring elements 212. When the piston 210 moves away from the faceplate 220 to overfill the ejection chamber 206, removing the drive signal D causes a drop of fluid to be ejected through the nozzle hole 222 in the faceplate 220. In this case, the fluid ejection process indirectly or passively controlled by the drive signal D, as fluid is ejected only after the drive signal D is removed.

When the magnetic force moves the piston 210 toward the faceplate 220, a drop of fluid is ejected through the nozzle hole 222 in the faceplate 220. Then, when the drive signal D is turned off, the current flowing in the primary coil 230 is stopped, removing the magnetic field and eliminating the magnetic force. The piston 210 then resiliently returns to its at-rest position under the bias of the spring elements 212, thereby refilling the ejected fluid in the fluid ejector 200. In this latter case, the fluid ejection process is directly or actively controlled by the drive signal D from the drive signal source.

FIGS. 9 and 10 show a first exemplary configuration of the fluid ejector 200 in which the primary coil 230 is associated with the piston 210. The faceplate 220 in this first exemplary configuration is either fabricated from a magnetic material, coated with a magnetic material, or otherwise connected to a magnetic material element 224.

The drive signal source supplies the drive signal D to the primary coil 230 causing a current to flow in a first direction, as shown by the current flow direction arrows on the primary coil 230. As a result, an attractive magnetic field is generated between the piston 210 and the faceplate 220. The resilient force of the spring elements 212 returns the piston 210 to its unactuated or at-rest position.

It should be appreciated that operation of the first exemplary configuration shown in FIGS. 9 and 10 requires only one controlled current.

Figure 11:
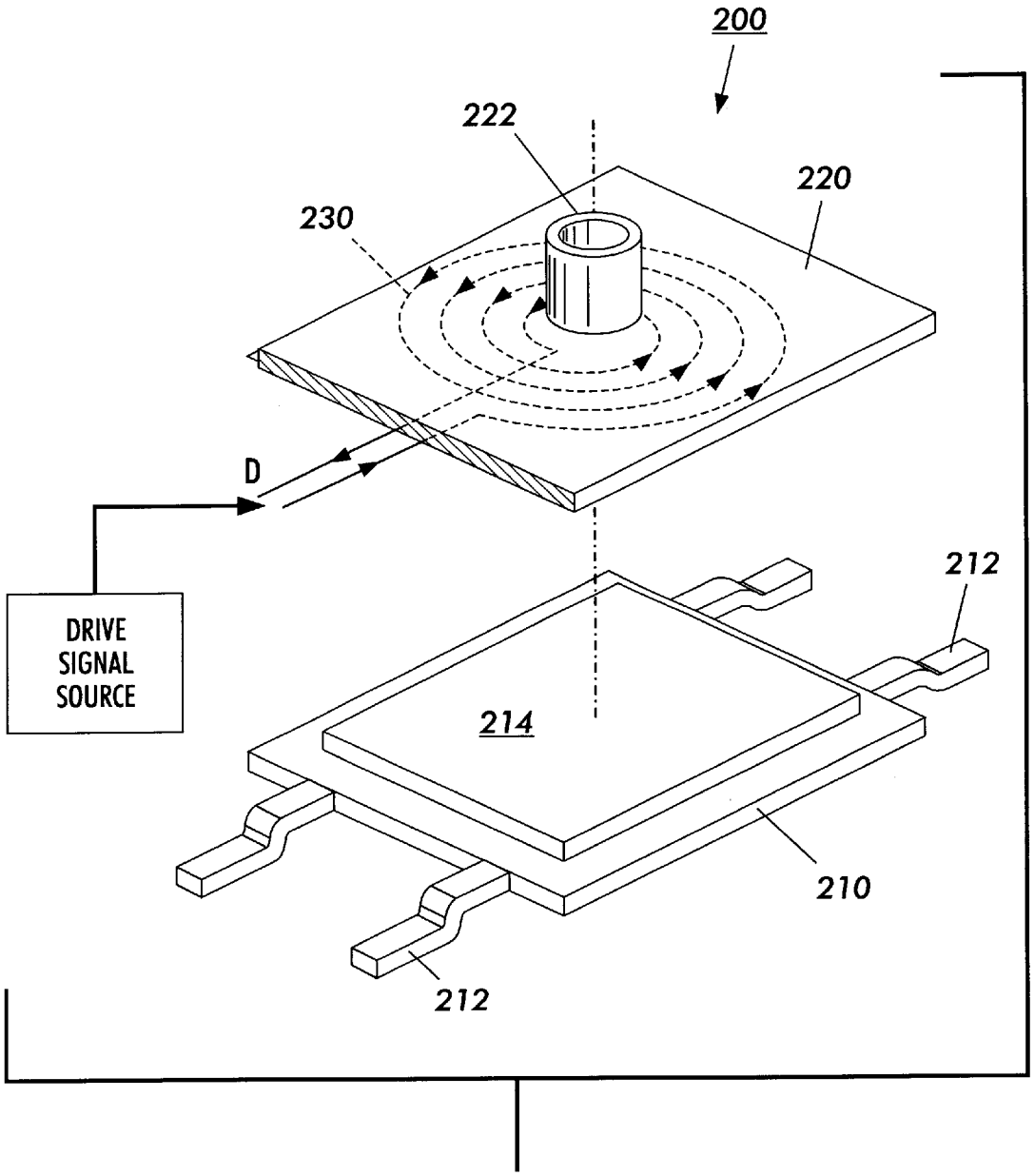
FIG. 11 is an exploded perspective view of a second exemplary configuration of the second exemplary embodiment of the fluid ejector shown in FIG. 9.
Figure 12:
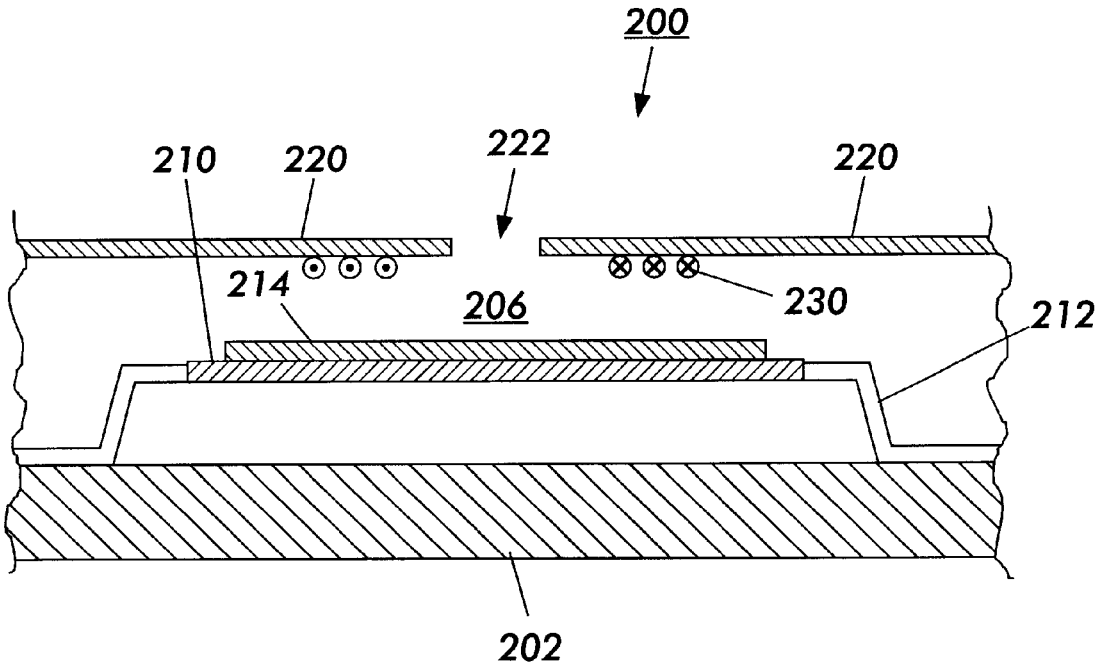
FIG. 12 is a cross-sectional view of the fluid ejector of FIG. 11.

FIGS. 11 and 12 show a second exemplary configuration of the fluid ejector 200 in which the primary coil 230 is associated with the faceplate 220 and the piston 210 is made of a magnetic material, or is coated with or otherwise connected to a magnetic material element 214. The operation of this second exemplary configuration is identical to that described above for the first exemplary configuration shown in FIGS. 9 and 10. Again, only one controlled current is needed for operation. However, the different configurations of FIGS. 9 and 10 and FIGS. 11 and 12 allow for flexibility in arranging and locating the drive signal source.

Figure 13:
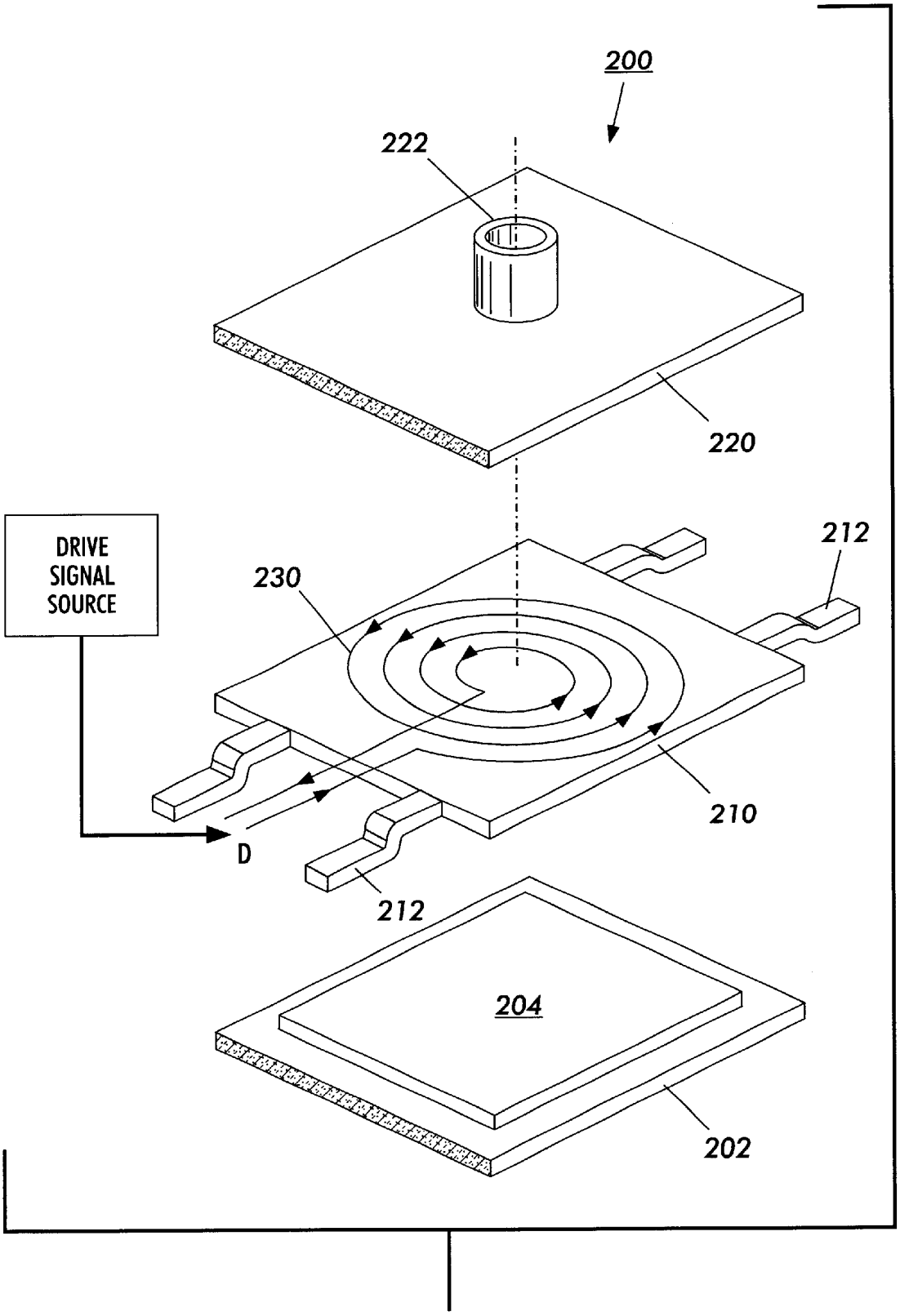
FIG. 13 is an exploded perspective view of a third exemplary configuration of the second exemplary embodiment of the fluid ejector shown in FIG. 9.
Figure 14:
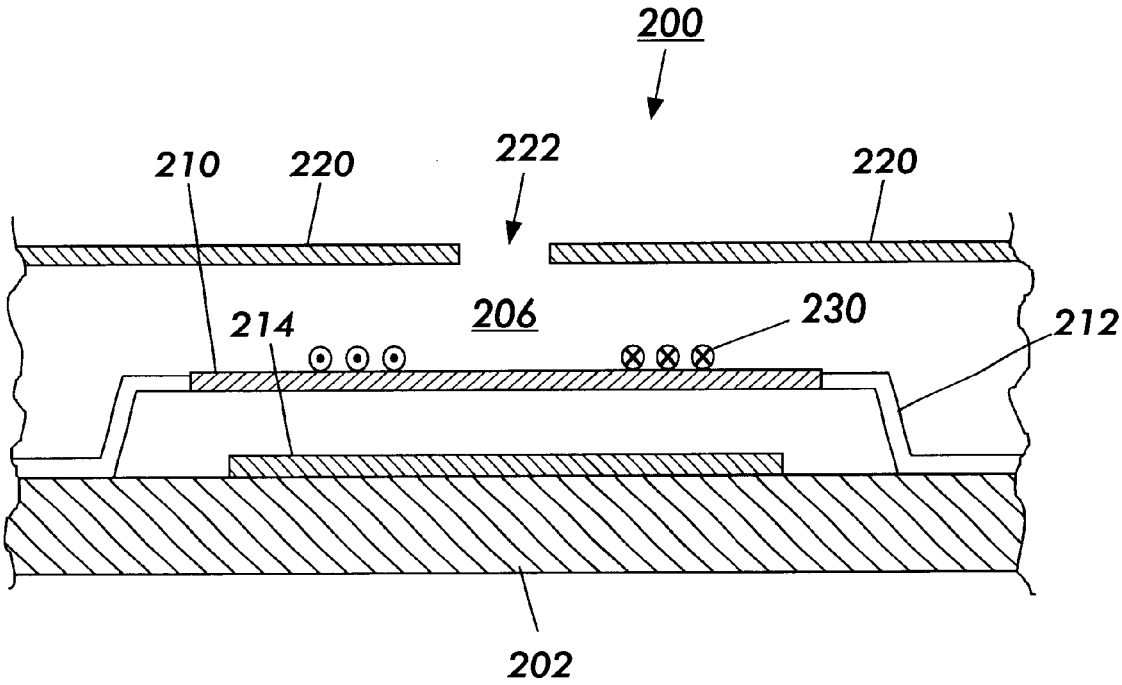
FIG. 14 is a cross-sectional view of the fluid ejector of FIG. 13.

FIGS. 13 and 14 show a third exemplary configuration of the fluid ejector 200 in which the primary coil 230 is associated with the piston 210 and the substrate 202 is made of a magnetic material, or is coated with or otherwise connected to a magnetic material element 204.

The drive signal source supplies the drive signal D to the primary coil 230, causing a current to flow in a first direction, as shown by the current flow direction arrows on the primary coil 230. As a result, an attractive field is generated between the piston 210 and the substrate 202. As a result, the piston 210 moves away from the faceplate 220 and additional fluid is drawn into the fluid chamber 206. The resilient force of the spring elements 212 returns the piston 210 to its unactuated or at-rest position, causing a drop of the fluid to be ejected through the nozzle hole 222.

Again, operation of the configuration shown in FIGS. 13 and 14 requires only one controlled current.

Figure 15:
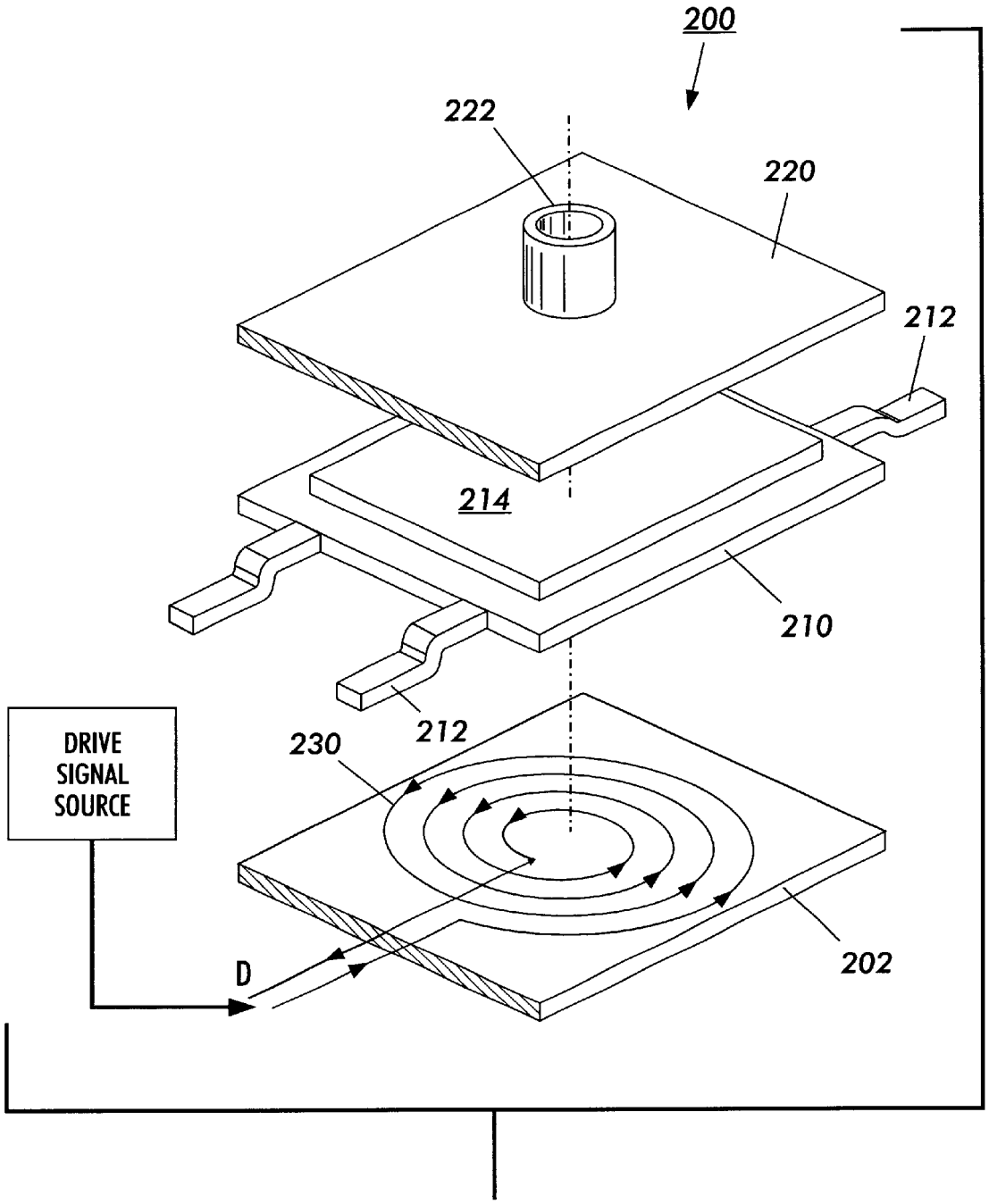
FIG. 15 is an exploded perspective view of a fourth exemplary configuration of the second exemplary embodiment of the fluid ejector shown in FIG. 9.
Figure 16:
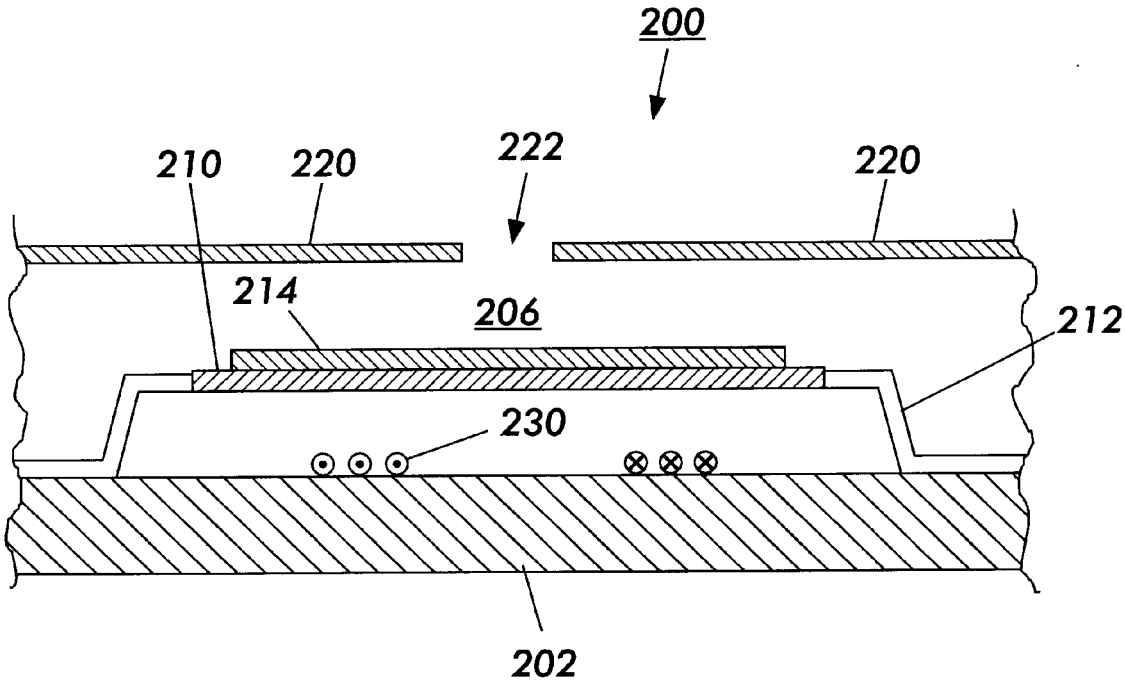
FIG. 16 is a cross-sectional view of the fluid ejector of FIG. 15.

FIGS. 15 and 16 show a fourth exemplary configuration of the second exemplary embodiment of the fluid ejector 200 in which the primary coil 230 is associated with the substrate 202 and the piston 210 is made of a magnetic material, or is coated with or otherwise connected to the magnetic material element 214. The operation of this fourth exemplary configuration is identical to that described above for the configuration shown in FIGS. 13 and 14. Again, only one controlled current is needed for operation. However, the different configurations of FIGS. 13 and 14 and FIGS. 15 and 16 allow for flexibility in arranging and locating the drive signal source, as well as flexibility in the magnetic material associated with the piston 210.

FIGS. 17–22 illustrate various exemplary configurations of a third exemplary embodiment of a fluid ejector 300 including a magnetic drive system according to this invention. It should be appreciated that the configurations shown in FIGS. 17–22 are provided as examples only, and are not exhaustive or limiting.

Figure 17:
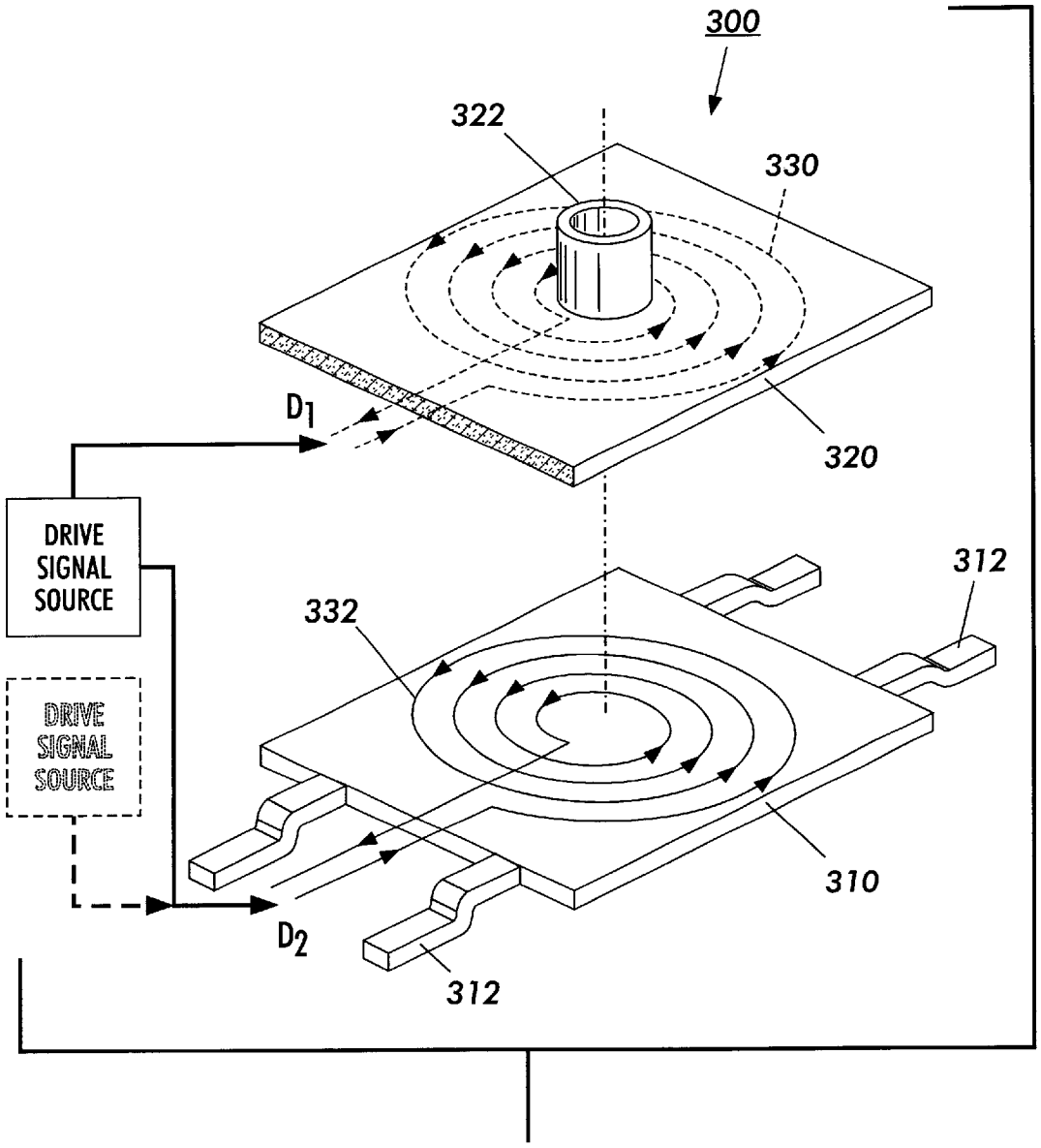
FIG. 17 is an exploded perspective view of a fluid ejector including a first exemplary configuration of a third exemplary embodiment of a magnetic drive system according to this invention.
Figure 18:
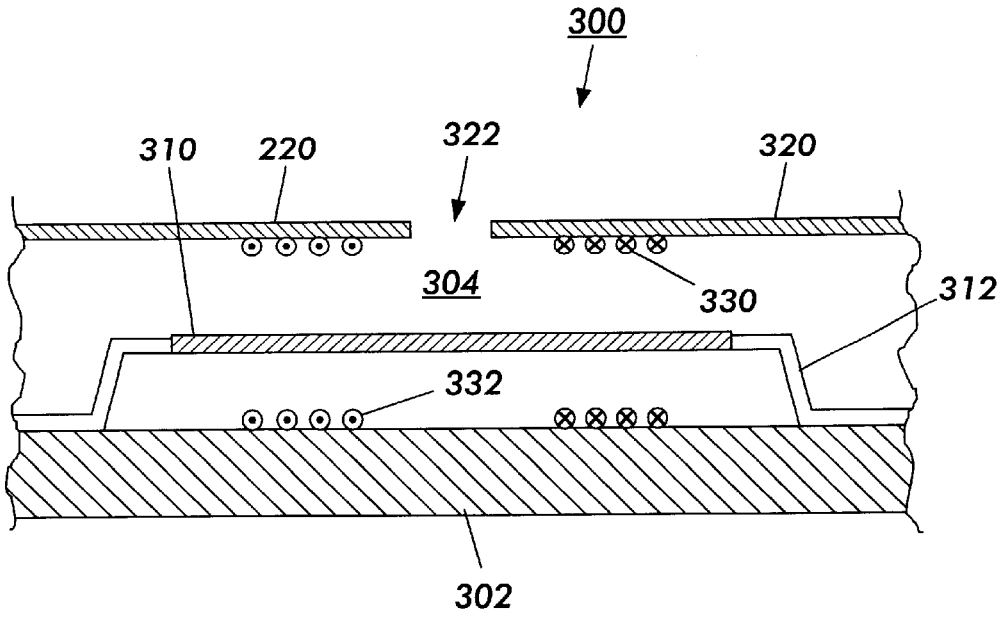
FIG. 18 is a cross-sectional view of the first exemplary configuration of the fluid ejector of FIG. 17 in a first driving state.

In the third exemplary embodiment shown in FIGS. 17–22, the fluid ejector 300 has a movable piston 310 usable to eject fluid through a nozzle hole 322. The piston 310 may be resiliently mounted and may include one or more spring elements 312 that are connected to a fixed portion of the fluid ejector 300, such as, for example, a substrate 302, as shown in FIG. 18. The spring elements 312 bias the piston 310 to an at-rest position. The fluid ejector 300 also has a faceplate 320 that includes the nozzle hole 322 through which a drop of fluid may be ejected.

A first primary coil 330 to which a first drive signal $D_1$ is to be applied is situated in the fluid ejector 300. Further, a second primary coil 332 to which second drive signal $D_2$ is to be applied is also situated in the fluid ejector 300. Either the first primary coil 330 or the second primary coil 332 is associated with the piston 310. It should be appreciated that the first primary coil 330 or the second primary coil 332 may be associated with the piston 310 in any suitable manner that causes the piston 310 to experience a force acting on the first primary coil 330 or the second primary coil 332, respectively. For example, the first primary coil 330 or the second primary coil 332 may be mounted on or formed on a surface of the piston 310. The first primary coil 330 or the second primary coil 332 may also be embedded in or formed as part of the piston 310. The other of the first primary coil 330 and the second primary coil 332 is associated with a fixed portion or structure of the fluid ejector 300.

In operation, the first drive signal $D_1$ is applied by a first drive signal source to the first primary coil 330. At the same time, the second drive signal $D_2$ is applied by that first drive signal source or, optionally, a second drive signal source, to the second primary coil 332. The drive signals $D_1$ and $D_2$ cause a current to flow in the first primary coil 330 and the second primary coil 332, respectively. Each of the current flows in the first and second primary coils 330 and 332 generates a distinct magnetic field. Depending on the directions of the currents flowing in the first primary coil 330 and the second primary coil 332, the generated magnetic fields create either a repulsive or attractive magnetic force between the first primary coil 330 and the second primary coil 332. Thus, by switching the direction of the current flowing in one of the first and second primary coils 330 and 332, the magnetic force may be switched between attractive and repulsive. Alternatively, the currents may be in only one direction in the first and second primary coils 330 and 332 with the piston 310 resiliently mounted as described above. Since one of the first primary coil 330 and the second primary coil 332 is associated with the piston 310 and the other of the primary coil 330 and the second primary coil 332 is associated with a fixed portion or structure of the fluid ejector 300, the piston 310 is moved by the magnetic force, either towards or away from the faceplate 320, which is also a fixed structure of the fluid ejector 300.

When the magnetic force moves the piston 310 away from the faceplate 320, fluid from a fluid reservoir (not shown) refills or overfills the ejection chamber 304 between the faceplate 320 and the piston 310. Then, when one or both of the drive signals $D_1$ and $D_2$ are turned off, one or both of the currents flowing in the first and second primary coils 330 and 332 are stopped, removing at least one of the magnetic fields and thus eliminating the magnetic force between the first and second primary coils 330 and 332. The piston 310 then resiliently returns to its at-rest position under a force of the spring elements 312. When the piston 310 is moved away from the faceplate 320 to overfill the ejection chamber 304, removing the magnetic force between the first and second primary coils 330 and 332 causes a drop of fluid to be ejected through the nozzle hole 322 in the faceplate 320. In this way, the fluid ejection process is indirectly or passively controlled by one or both of the drive signals $D_1$ as fluid is ejected only after one or both drive signals D, and $D_2$ are removed.

When the magnetic force moves the piston 310 toward the faceplate 320, a drop of fluid is ejected through the nozzle hole 322 in the faceplate 320. Then, when one or both of the first and second drive signals $D_1$ and $D_2$ are turned off, the currents flowing in one or both of the first and second primary coils 330 and 332 are stopped, removing at least one of the magnetic fields and eliminating the magnetic force between the first and second primary coils 330 and 320. The piston 310 then resiliently returns to its at-rest position under the bias of the spring elements 312, thereby refilling the ejected fluid in the fluid ejector 300. In this latter case, the fluid ejection is directly or actively controlled by the drive signals $D_1$ and $D_2$.

As noted above, switching the direction of one of the currents flowing in the first and second primary coils 330 and 332 switches the magnetic force between the first and second primary coils 330 and 332 from attractive to repulsive or vice versa Thus, the two cases described above may be combined so that both fluid ejection and fluid refilling are directly or actively controlled by the drive signals $D_1$ and $D_2$.

Figure 19:
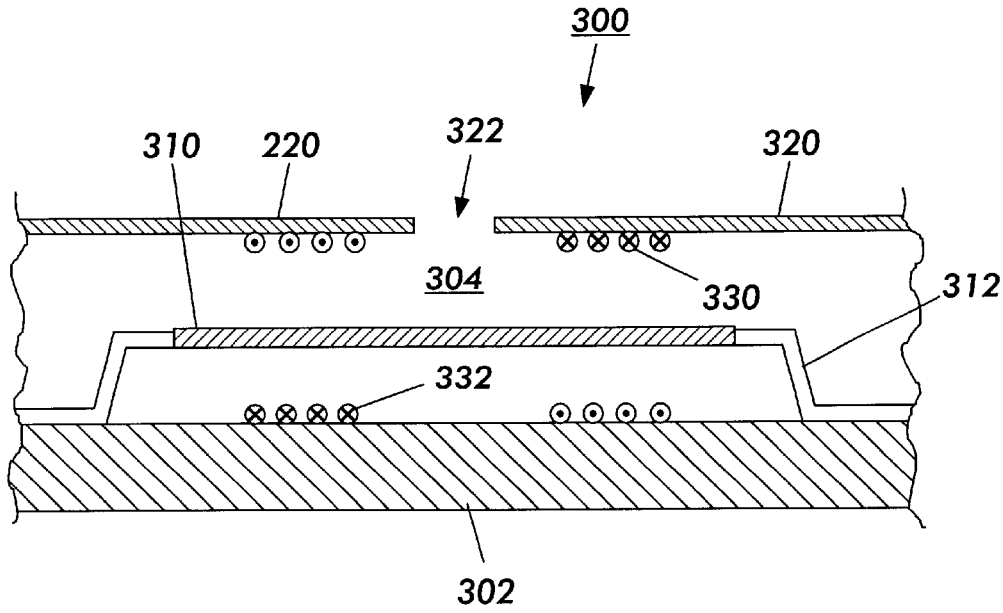
FIG. 19 is a cross-sectional view of the first exemplary configuration of the fluid ejector of FIG. 17 in a second driving state.

FIGS. 17, 18 and 19 show a first exemplary configuration of the fluid ejector 300 in which the first primary coil 330 is associated with the faceplate 320 and the second primary coil 332 is associated with the piston 310. A first current path is defined by the first primary coil 330 and a second current path is defined by the second primary coil 332.

In operation, at least one drive signal source supplies the first drive signal D, to the first primary coil 330 so that a first current flows in the first primary coil 330 in a first direction, as indicated by the current flow direction arrows on the first primary coil 330. The at least one drive signal source supplies a second drive signal $D_2$ to the second primary coil 332 so that a second current flows in the second primary coil 332 in a second direction, as indicated by the current flow direction arrows on the second coil 332. Thus, the first and second currents generate a magnetic field between the piston 310 and the faceplate 320.

The direction, repulsive or attractive, of the resulting magnetic force depends on the directions of the first and second currents flowing in the first and second primary coils 330 and 332, respectively. As shown in FIG. 18, when the first and second currents in the first and second primary coils 330 and 332 flow in the same direction, an attractive magnetic force is generated that pulls the piston 310 towards the faceplate 320, causing a drop of fluid to be ejected through the nozzle hole 322 by the piston 310. As shown in FIG. 19, when the first and second currents in the first and second primary coils 330 and 332 flow in opposite directions, a repulsive magnetic force is generated that pushes the piston 310 away from the faceplate 320 causing fluid to overfill the ejection chamber 304 between the piston 310 and the faceplate 320.

If no current switching is utilized, a single current flow direction for both the first and second currents in the first and second primary coils 330 and 332 may be used to generate a unidirectional force to either pull the piston 310 and the faceplate 320 together or push them apart, depending upon where the coils are located. The motion of the piston 310 in the opposite direction may then be accomplished by utilizing the resilient forces of the spring elements 312 to return the piston 310 to its unactuated or at-rest position.

Figure 20:
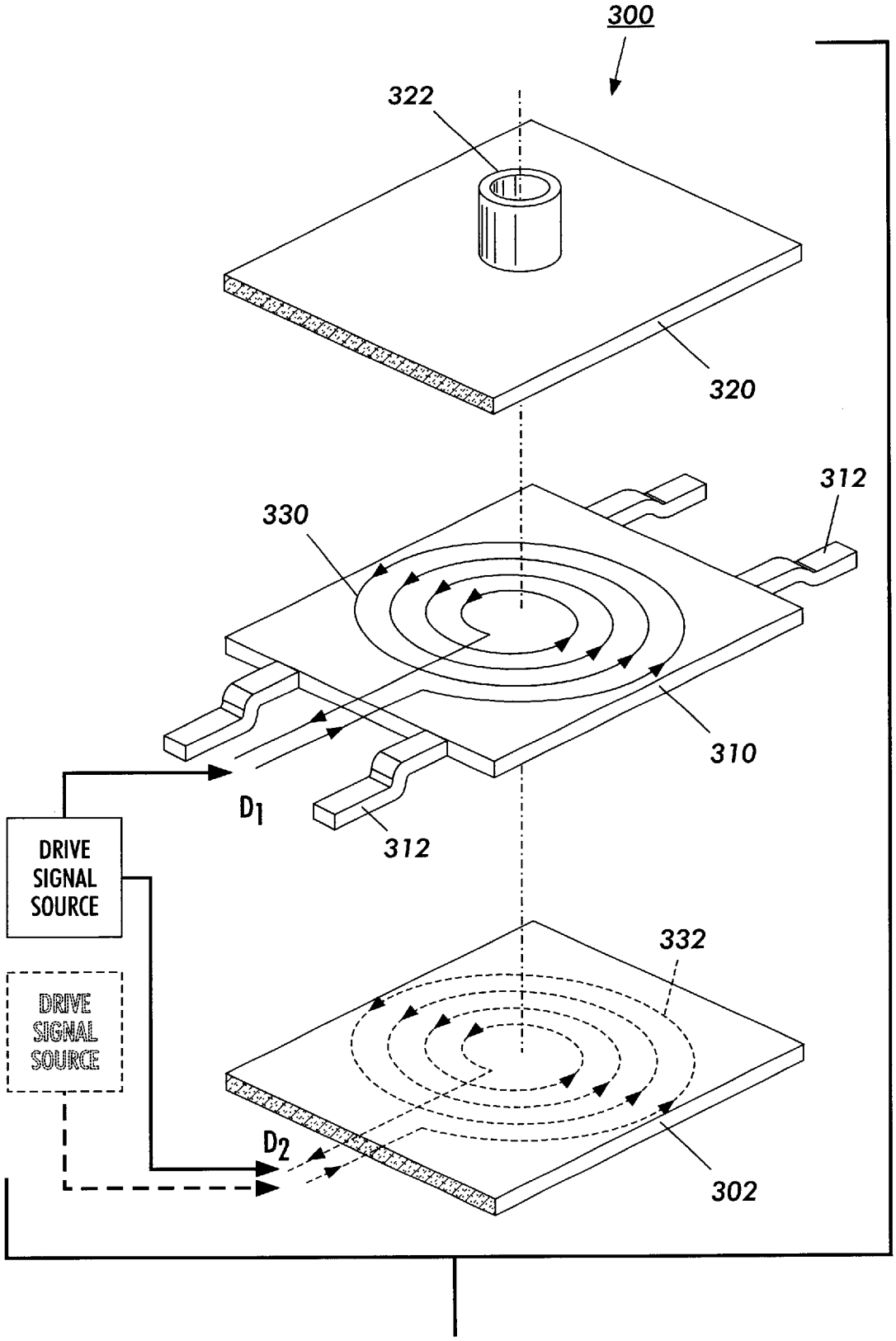
FIG. 20 is an exploded perspective view of a second exemplary configuration of the third exemplary embodiment of the fluid ejector shown in FIG. 17.
Figure 21:
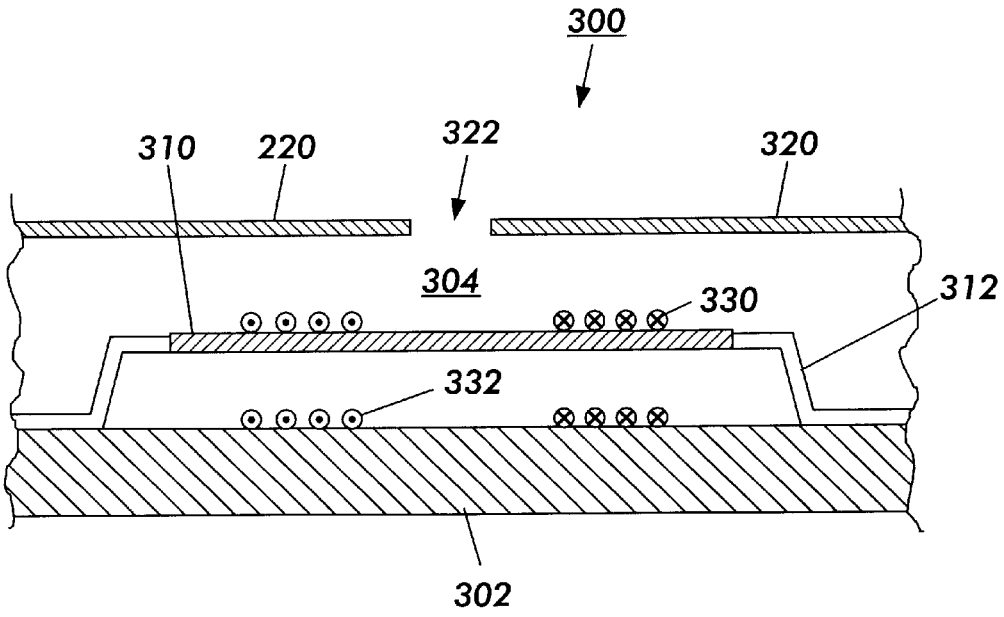
FIG. 21 is a cross-sectional view of the second exemplary configuration of the fluid ejector of FIG. 20 in a first driving state.
Figure 22:
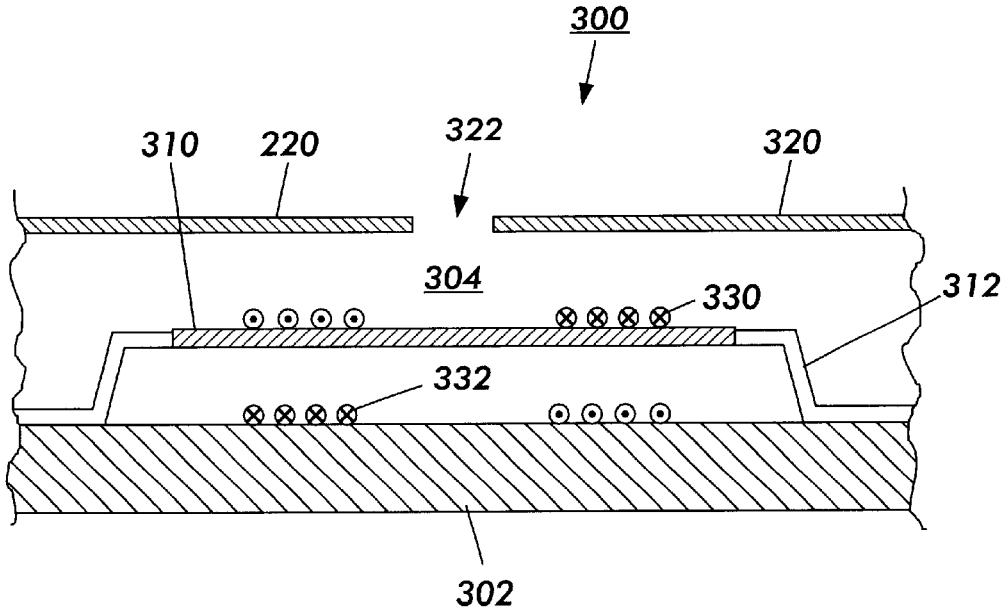
FIG. 22 is a cross-sectional view of the second exemplary configuration of the fluid ejector of FIG. 20 in a second driving state.

FIGS. 20, 21 and 22 show a second exemplary configuration of the fluid ejector 300 in which the first primary coil 330 is associated with the piston 310 and the second primary coil 332 associated with the substrate 302, which is located on the opposite side of the piston 310 from the faceplate 320.

In operation, at least one drive signal source supplies the first drive signal $D_1$ to the first primary coil 330, so that a first current flows in the first primary coil 330 in a first direction, as indicated by the current flow direction arrows on the first primary coil 330. The at least one drive signal source supplies a second drive signal $D_2$ to the second primary coil 332, so that a second current flows in the second primary coil 332 in a second direction, as indicated by the current flow direction arrows on the second primary coil 332. Thus, the first and second currents generate a magnetic field between the piston 310 and the substrate 302.

The direction, repulsive or attractive, of the resulting magnetic force depends on the directions of the first and second currents flowing in the first and second primary coils 330 and 332, respectively. When the first and second currents in the first and second primary coils 330 and 332 flow in the same direction, as shown in FIG. 21, an attractive magnetic force is generated that pulls the piston 310 away from the faceplate 320, causing fluid to overfill the ejection chamber 304 between the piston 310 and the faceplate 320. When the first and second currents in the first and second primary coils 330 and 332 flow in opposite directions, as shown in FIG. 22, a repulsive magnetic force is generated that pushes the piston 310 toward the faceplate 320 causing a drop of fluid to be ejected through the nozzle hole 322 by the piston 310.

Again, if no current switching is utilized, a single current flow direction for both the first and second currents in the first and second primary coils 330 and 332 may be used to generate a unidirectional force to either pull the piston 310 away from the faceplate 320 or push the piston 310 towards the faceplate 320. The motion of the piston 310 in the opposite direction may then be accomplished by utilizing the resilient forces of the spring elements 312 to return the piston 310 to its unactuated or at-rest position.

Figure 23:
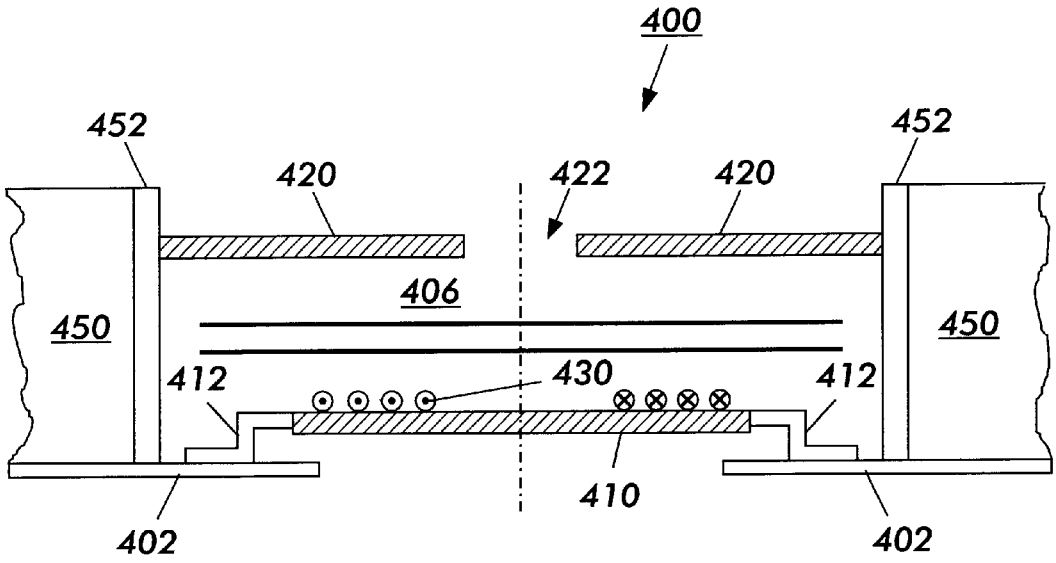
FIG. 23 is a cross-sectional view of a fluid ejector including a first exemplary configuration of a fourth exemplary embodiment of a magnetic drive system according to this invention.
Figure 24:
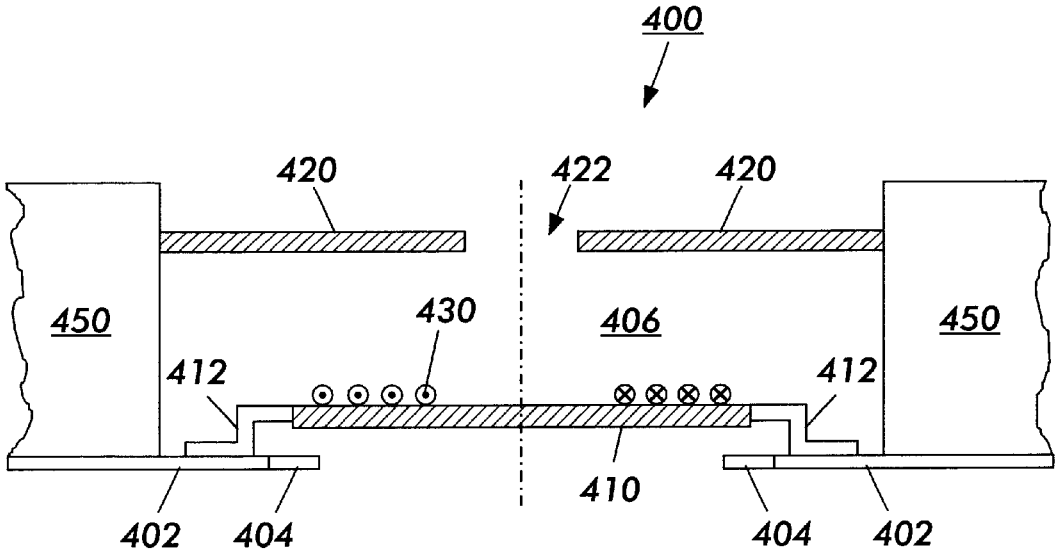
FIG. 24 is a cross-sectional view of a second exemplary configuration of the fourth exemplary embodiment of the fluid ejector shown in FIG. 23.
Figure 25:
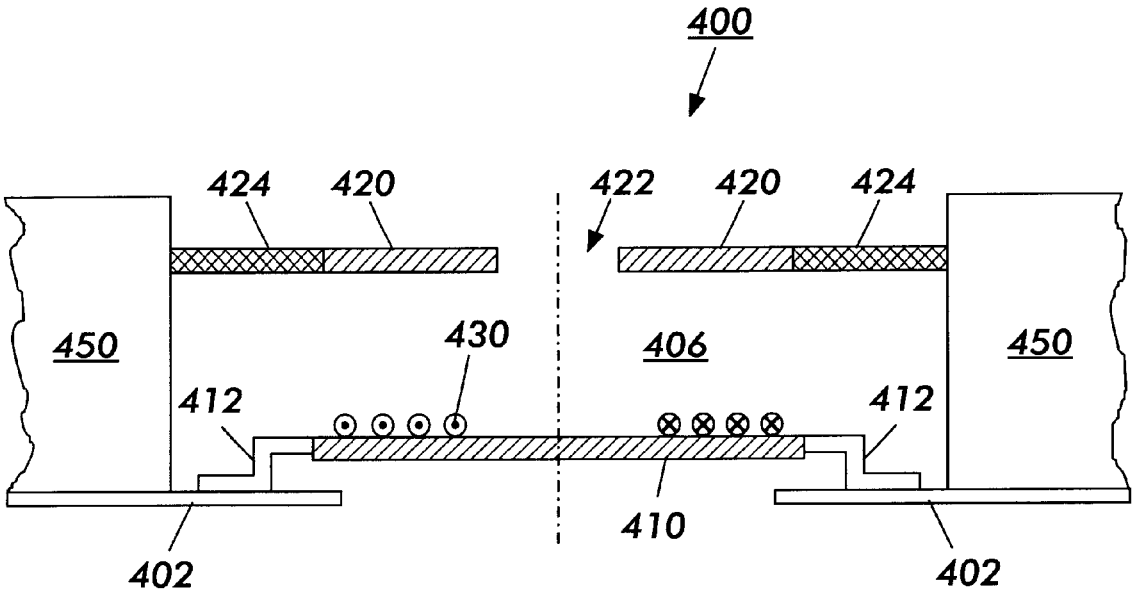
FIG. 25 is a cross-sectional view of a third exemplary configuration of the fourth exemplary embodiment of the fluid ejector shown in FIG. 23.

FIGS. 23–25 illustrate various exemplary configurations of a fourth exemplary embodiment of a fluid ejector 400 including a magnetic drive system according to this invention. It should be appreciated that the configurations shown in FIGS. 23–25 are provided as examples only, and are not exhaustive or limiting.

In the fourth exemplary embodiment, the fluid ejector 400 has a movable piston 410 usable to eject fluid through a nozzle hole 422, as shown in FIG. 23. The piston 410 may be resiliently mounted and may include one or more spring elements 412 that are connected to a fixed portion of the fluid ejector 400, such as, for example, a substrate 402, as shown in FIG. 24. The spring elements 412 bias the piston 410 to an at-rest position. The fluid ejector 400 also has a faceplate 420 that includes the nozzle hole 422 through which a drop of fluid may be ejected.

A first primary coil 430 to which a drive signal is to be applied is situated in the fluid ejector 400. A permanent magnet 404, 424 or 452 is also situated in the fluid ejector 400. Either the primary coil 430 or the permanent magnet is associated with the piston 410. It should be appreciated that the primary coil 430 or the permanent magnet may be associated with the piston 410 in any suitable manner that causes the piston 410 to experience a force acting on the primary coil 430 or the permanent magnet, respectively. For example, the primary coil 430 may be mounted on or formed on a surface of the piston 410. The primary coil 430 may also be embedded in or formed as part of the piston 410. The piston 410 may be partially or completely fabricated from a permanent magnet or otherwise connected to the permanent magnet. The other of the primary coil 430 and the permanent magnet 404, 424 or 452 is associated with a fixed portion or structure of the fluid ejector 400.

In operation, a drive signal is applied by a drive signal source (not shown) to the primary coil 430. The drive signal causes a current to flow in the primary coil 430. The current flow in the primary coil 430 creates a first magnetic field that cooperates with a second magnetic field generated by the permanent magnet 404, 424 or 452. Depending on the direction of the current flowing in the primary coil 430, the interaction of the first and second magnetic fields creates either a repulsive or attractive magnetic force between the primary coil 430 and the permanent magnet 404, 424 or 452. Thus, by switching the direction of the current flowing in the primary coil 430, the magnetic force may be switched between attractive and repulsive. Alternatively, the current may be in only one direction in the primary coil 430 with the piston 410 resiliently mounted as described above. Since the primary coil 430 or the permanent magnet 404, 424 and 452 is associated with the piston 410, and the other of the primary coil 430 and the permanent magnet 404, 424 or 452 is associated with a fixed portion or structure of the fluid ejector 400, the piston 410 is moved by the magnetic force either towards or away from the faceplate 420, which is also a fixed structure of the fluid ejector 400.

When the magnetic force moves the piston 410 away from the faceplate 420, fluid from a fluid reservoir (not shown) refills or overfills the ejection chamber 406 between the faceplate 420 and the piston 410. Then, when the drive signal is turned off, the current flowing in the primary coil 430 is stopped, eliminating the magnetic force. The piston 410 then resiliently returns to its at-rest position under a force of the spring elements 412. When the piston 410 is moved away from the faceplate to overfill the ejection chamber 406, removing the magnetic force causes a drop of fluid to be ejected through the nozzle hole 422 in the faceplate 420. In this way, the fluid ejection process is indirectly or passively controlled by the drive signal, as fluid is ejected only after the drive signal is removed.

When the magnetic force moves the piston 410 toward the faceplate 420, a drop of fluid is ejected through the nozzle hole 422 in the faceplate 420. Then, when the drive signal is turned off, the current flowing in the primary coil 430 is stopped, eliminating the first magnetic field, and thus the force between the piston 410 and the permanent magnet 404, 424 or 452. The piston 410 then resiliently returns to its at-rest position under the bias of the springs 412, thereby refilling the ejected fluid in the fluid ejector 400. In this latter case, the fluid ejection is directly or actively controlled by the drive signal of the drive signal source.

As noted above, switching the direction of the current flowing in the primary coil 430 switches the magnetic force between attractive and repulsive. Thus, the two cases described above may be combined so that both the fluid ejection and the fluid refill are directly or actively controlled by the drive signal of the drive signal source.

FIG. 23 show a configuration of the fluid ejector 400 in which the piston 410 includes the primary coil 430 to which the drive signal is to be applied. Permanent magnets 452 are located at the side walls 450 adjacent to the piston 410 and the faceplate 420 The permanent magnets 452 generate the second magnetic field, which extends ejection chamber 406 or the fluid across the ejector 400.

When the drive signal D is applied to cause current to flow in the primary coil 430, a vertical magnetic force is generated ($F=v\times B$) that either pushes the piston 410 away from the faceplate 420 or pulls the piston 410 towards the faceplate 420, depending on the direction of the current flowing in the primary coil 430 and the direction of the second magnetic field established by the permanent magnets 452. Thus, by reversing the direction of the current flow, the magnetic force may be switched between attractive and repulsive to reverse the direction of the motion of the piston 410.

Again, only one controlled current is required for operation. If no current switching is utilized, a single current flow direction may be used to generate a unidirectional force to either pull the piston 410 toward the faceplate 420 or push the piston 410 away from the faceplate 420. The motion of the piston 410 in the opposite direction may then be accomplished by utilizing resilient forces of the spring elements 412 to return the piston 410 to its unactuated or at-rest position.

FIG. 24 shows a second exemplary configuration of the fluid ejector 400 in which the substrate 402 is made of, or includes, one or more permanent magnets 404.

When the drive signal is applied to cause current to flow in the primary coil 430, the piston 410 effectively becomes an electromagnet with either a north pole or a south pole facing the one or more permanent magnets 404, depending on the direction of the current flowing in the primary coil 430. Thus, depending on the direction of the second magnetic field established by the one or more permanent magnets 404, the piston 410 is either attracted to or repelled by the one or more permanent magnets 404, so that the piston 410 is pulled away from the faceplate 420 or the piston 410 is pushed towards the faceplate 420. By reversing the direction of the current flow, the magnetic force created by the interaction of the first and second magnetic fields may be switched between attractive and repulsive to reverse the direction of the motion of the piston 410.

Again, only one controlled current is required for operation. If no current switching is utilized, a single current flow direction may be used to generate a unidirectional force to either pull the piston 410 toward the faceplate 420 or push the piston 410 away from the faceplate 420. The motion of the piston 410 in the opposite direction may then be accomplished by utilizing resilient forces of the spring elements 412 to return the piston 410 to its unactuated or at-rest position.

FIG. 25 shows a third exemplary configuration of the fluid ejector 400 in which the faceplate 420 is made, of or includes, one or more permanent magnets 424.

When the drive signal is applied to cause current to flow in the primary coil 430, the piston 410 effectively becomes an electromagnet with either a north pole or a south pole facing the one or more permanent magnets 424, depending on the direction of the current flowing in the primary coil 430. Thus, depending on the direction of the second magnetic field established by the one or more permanent magnets 424, the piston 410 is either attracted or repelled by the one or more permanent magnets 424, so that the piston 410 is pulled toward the faceplate 420 or the piston 410 is pushed away from the faceplate 420. By reversing the direction of the current flow, the magnetic force created by the interaction of the first and second magnetic fields may be switched between attraction and repulsion to reverse the direction of motion of the piston 410.

Again, only one controlled current is required for operation. If no current switching is utilized, a single current flow direction may be used to generate a unidirectional force to either pull the piston 410 toward the faceplate 420 or push the piston 410 away from the faceplate 420. The motion of the piston 410 in the opposite direction may then be accomplished by utilizing resilient forces of the spring elements 412 to return the piston 410 to its unactuated or at-rest position.

The systems of this invention fabricate the fluid ejectors in various exemplary embodiments using surface micromachining of a polysilicon structure with metal deposition on the polysilicon to produce current paths that can withstand the high current densities required to create sufficiently-strong magnetic fields. The metal may be deposited using electroplating, sputtering or evaporation, and patterned photolithography. The excess metal may then be etched and removed using various etch techniques. Alternate MEMS manufacturing technologies, such as LIGA, may also be used. The one or more permanent magnets of the fourth exemplary embodiment are assembled into the micromachined ejector structure by, for example, chemical or physical vapor deposition, including plasma methods, electrodeposition or attachment by adhesive.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method for ejecting a fluid form a fluid ejector, comprising:

generating a magnetic force that moves a movable member of a fluid ejector to alter a capacity of a fluid chamber of the fluid ejector; and ejecting fluid from the ejector based on the altered capacity of the fluid chamber.

2. The method of claim 1, wherein the generated magnetic force selectively moves the movable member in a first direction and a second direction opposite the first direction.

3. The method of claim 1, wherein ejecting fluid from the ejector is directly controlled by movement of the movable member by the generated magnetic force.

4. The method of claim 1, wherein generating the magnetic force comprises applying current to a primary coil to generate a magnetic field between the movable member and a fixed portion of the fluid ejector.

5. The method of claim 4, wherein a direction of the current applied to the primary coil is switched to change between an attractive magnetic force and a repulsive magnetic force the magnetic force between the movable member and the fixed portion.

6. The method of claim 4, wherein generating the magnetic force further comprises inducing a current in a secondary coil.

7. The method of claim 4, wherein generating the magnetic force further comprises using a magnetic material.

8. The method of claim 4, wherein generating the magnetic force further comprises using a permanent magnet.

9. The method of claim 4, wherein generating the magnetic force further comprises applying current to a second primary coil to generate a second magnetic field between the movable member and the fixed portion of the fluid ejector.

10. The method of claim 9, wherein a direction of the current applied to one of the primary coil and the second primary coil is switched to change the magnetic force between the movable member and the fixed portion between an attractive magnetic force and a repulsive magnetic force.

11. A magnetic drive system for a fluid ejector having an ejection chamber, comprising:

a movable member located in the ejection chamber;

at least one primary coil; and at least one drive signal source that applies a drive signal to cause a current to flow in the primary coil;

wherein the current flow in the primary coil generates a magnetic field that moves the movable member within the ejection chamber.

12. The magnetic drive system of claim 11, wherein the drive signal source is arranged to switch the drive signal such that a direction of the flow of the current in the primary coil is reversible.

13. The magnetic drive system of claim 11, further comprising at least one resilient support member connected to the movable member such that the movable member is biased to a rest position when the drive signal is not applied.

14. The magnetic drive system of claim 11, further comprising a secondary coil wherein, when the drive signal is applied to the primary coil, the secondary coil is located within the generated magnetic field, the generated magnetic field inducing a current in the secondary coil, the induced current generating a second magnetic field, such that a repulsive magnetic force is generated between the primary and second coils.

15. The magnetic drive system of claim 14, wherein the secondary coil is associated with the movable member.

16. The magnetic drive system of claim 15, wherein the primary coil is associated with a fixed member of the fluid ejector.

17. The magnetic drive system of claim 14, wherein the primary coil is associated with the movable member.

18. The magnetic drive system of claim 17, wherein the secondary coil is associated with a fixed member of the fluid ejector.

19. The magnetic drive system of claim 11, further comprising a magnetic material wherein, when the drive signal is applied to the primary coil, the magnetic material is located within the generated magnetic field such that an attractive magnetic force is generated between the primary coil and the magnetic material.

20. The magnetic drive system of claim 19, wherein the magnetic material is associated with the movable member.

21. The magnetic drive system of claim 20, wherein the primary coil is associated with a fixed member of the fluid ejector.

22. The magnetic drive system of claim 19, wherein the primary coil is associated with the movable member.

23. The magnetic drive system of claim 22, wherein the magnetic material is associated with a fixed member of the fluid ejector.

24. The magnetic drive system of claim 11, wherein:

the at least one primary coil comprises a first primary coil associated with a fixed member and a second primary coil associated with the movable member;

the drive signal source is arranged to apply a first drive signal to the first primary coil to cause a first current to flow in the first primary coil and a second drive signal to the second primary coil to cause a second current to flow in the second primary coil; and the first current in the first primary coil and the second current in the second primary coil generate a magnetic force that moves the movable member.

25. The magnetic drive system of claim 24, wherein the drive signal source is arranged to switch the drive signal to one of the first and second primary coils such that a direction of the flow of a corresponding one of the first and second currents is reversible.

26. The magnetic drive system of claim 24, wherein the drive signal source comprises:

a first drive signal source that applies the first drive signal to the first primary coil; and a second drive signal source that applies the second drive signal to the second primary coil.

27. The magnetic drive system of claim 11, further comprising:

a permanent magnet that generates a magnetic field such that a magnetic force is generated between the permanent magnet and the primary coil when the drive signal is applied to the primary coil.

28. The magnetic drive system of claim 11, wherein the permanent magnet is associated with a fixed member.

* * * * *

UNITED STATES PATENT AND TRADEMARK OFFICE

CERTIFICATE OF CORRECTION

PATENT NO. : 6,350,015 B1 
DATED : February 26, 2002
INVENTOR(S) : Gooray et al.

It is certified that error appears in the above-identified patent and that said Letters Patent is hereby corrected as shown below:

Column 1,
After the Title, please insert the following paragraph:

-- GOVERNMENT RIGHTS
This invention was made with Government support under Contract No. DE-AC04-94AL85000 awarded by the U.S. Department of Energy. The Government has certain rights in the invention. --

Signed and Sealed this

Third Day of December, 2002

JAMES E. ROGAN
*Director of the United States Patent and Trademark Office*